US005849113A

United States Patent [19]

Murakami et al.

[11] Patent Number: 5,849,113

[45] Date of Patent: Dec. 15, 1998

[54] ELECTRICAL RESISTANT ALLOY HAVING A HIGH TEMPERATURE COEFFICIENT OF RESISTANCE

[75] Inventors: Yuetsu Murakami; Katashi Masumoto; Naoji Nakamura, all of Sendai, Japan

[73] Assignee: The Foundation: The Research Institute of Electric and Magnetic Alloys, Sendai, Japan

[21] Appl. No.: 720,064

[22] Filed: Sep. 27, 1996

[51] Int. Cl.[6] ..... C22C 5/00; C22C 38/00

[52] U.S. Cl. ..... 148/430; 148/327; 148/320; 420/463

[58] Field of Search ..... 420/463; 148/320, 148/337, 442, 430

[56] References Cited

U.S. PATENT DOCUMENTS

| | | | |
|---|---|---|---|
| 3,136,634 | 6/1964 | Zwingman | 420/463 |
| 4,481,045 | 11/1984 | Watanabe | 420/463 |
| 4,728,580 | 3/1988 | Grasselli et al. | 420/463 |

FOREIGN PATENT DOCUMENTS

| | | | |
|---|---|---|---|
| 204847 | 10/1985 | Japan | 420/463 |

*Primary Examiner*—Deborah Yee
*Attorney, Agent, or Firm*—Kubovcik & Kubovcik

[57] ABSTRACT

High temperature coefficient of resistance (TCR) appropriate for the sensor devices is attained by an alloy consisting, by atomic %, of from 5 to 65% of Fe, and from 0.01 to 20% in total of at least one auxiliary component selected from the group consisting of 20% or less of Ni, 20% or less of Co, 20% or less of Ag, 20% or less of Au, 20% or less of Pt, 10% or less of Rh, 10% or less of Ir, 10% or less of Os, 10% or less of Ru, 10% or less of Cr, 5% or less of V, 5% or less of Ti, 5% or less of Zr, 5% or less of Hf, 8% or less of Mo, 5% or less of Nb, 10% or less of W, 8% or less of Ta, 3% or less of Ga, 3% or less of Ge, 3% or less of In, 3% or less of Be, 5% or less of Sn, 3% or less of Sb, 5% or less of Cu, 5% or less of Al, 5% or less of Si, 2% or less of C, 2% or less of B, and 5% or less of a rare earth element, the balance being essentially Pd and minor amount of impurities, and said alloy having $4000\times10^{-6}$° C.$^{-1}$ or more of TCR in a temperature range of from 0° to 200° C. The alloy may further contain from 5 to 65% of Mn.

8 Claims, 19 Drawing Sheets

ELECTRICAL RESISTANT ALLOY HAVING A HIGH TEMPERATURE COEFFICIENT OF RESISTANCE

BACKGROUND OF INVENTION

1. Field of Invention

The present invention relates to an electrical resistant alloy having a high temperature coefficient of resistance, and a method for producing this alloy. The present invention also relates to various sensor devices using this alloy.

2. Description of Related Art

Pure platinum, pure nickel or thermistor, which exhibits a high temperature coefficient of resistance (hereinafter referred to as "TCR"), are conventionally used as an element in a catalytic combustion-type gas sensor and a temperature sensor, in which temperature dependence of the electrical resistance of the pure platinum and the like is utilized to detect gas or temperature. Virtually the same electrical circuit is used in the gas or temperature sensor. Such circuit is illustrated with an example of the gas sensor shown in FIG. 1 which illustrates the principle of a bridge circuit.

In FIG. 1(B), the symbols $R_s$ and $R_c$ indicate the active resistor for detecting the gas and the standard resistor, respectively. $R_1$ and $R_2$ each indicates the balance resistor. The active resistor for detecting gas $R_s$ (hereinafter referred to as the active resistor $R_s$) may be surrounded by a catalyst for oxidation reaction of the gas. Electrical power is supplied from the power source $V_i$ to the four resistors $R_s$, $R_c$, $R_1$ and $R_2$. The balance voltage "V" is adjusted to zero with the aid of the variable resistor $R_c$. The active resistor $R_s$ and the standard resistor $R_v$ are then heated and brought into contact with a gas. The resistance of the active resistor $R_s$ is changed by ΔR due to the Joule heat generated in it and also due to an oxidation reaction and hence combustion of the gas. As a result, the output voltage ΔV is generated corresponding to the resistance change ΔR and hence to the gas concentration. The output voltage ΔV is expressed by:

$$\Delta V=(\Delta R/4R)\times V_i \quad (1)$$

Here, 4R is the total sum of four resistors $R_s$, $R_c$, $R_1$ and $R_2$. The ΔR in equation (1) is an index of gas sensitivity and changes depending upon the kind of gas and temperature. When the detecting selectivity of a gas is high, its concentration can be detected by equation (1).

FIG. 2 illustrates the output voltage of a gas sensor, in which a Pt filament (40 μm in diameter) is used as the active resistor $R_s$ for detecting gas. It is apparent from FIG. 2 that the gas sensitivity is high in a temperature range of from 130° to 200° C. for CO gas and in a temperature range of from 200° to 500° C. for hydrogen, ethanol, methane and isobutane. It is therefore necessary that the material selected for the active resistor $R_s$ for detecting a specific gas should have a high TCR at a particular temperature range dependent upon the specific gas to be detected as shown in FIG. 2.

The catalyst is not attached to the active resistor $R_s$ included in a temperature sensor which detects the ambient temperature. In such a sensor, the temperature can be precisely detected following equation (1) as also in the case of a gas sensor described hereinabove, since the resistance of the active resistor varies depending on the ambient temperature.

It will be understood from the above descriptions that the performance of the above described sensors are greatly influenced by the properties of the active resistor $R_s$. Pure platinum in the form of a coil has most frequently been used as active resistor $R_s$, because it has excellent coil-formability, electrical reliance, chemical stability and the like. Pure platinum has approximately $4000\times10^{-6}$° C.$^{-1}$ of TCR in the temperature range of from 0° to 200° C., approximately 11 μΩ.cm of resistivity and approximately 50 of Vickers hardness. The TCR of pure platinum is lower than the level required for various sensor devices having high sensitivity. In addition, the hardness is also low. Furthermore, platinum is expensive.

Contrary to this, pure nickel has a higher TCR than pure Pt. However, the resistivity of pure nickel is approximately 7 μΩ.cm and is hence as low as that of pure platinum. In addition, the oxidation resistance of pure nickel is poor. Pure nickel is therefore difficult to be practically used as the resistor material from the points described above.

It is known from the literature "Platinum Group and Its Industrial Utilization" (published by Sangyo Tosho Shuppan, page 440) that an Fe—Pd based alloy has a large TCR up to 100° C. The Fe—Pd based alloy is therefore expected to be applicable for a gas sensor or a temperature sensor. However, this alloy disadvantageously is rapidly oxidized, which incurs a serious change in the electrical resistance. The phase diagram of an Fe—Pd based alloy is unknown. Such various points as ρ—T characteristic, formability and oxidation resistance of phases other than $Fe_3Pd$ of the Fe—Pd based alloy remain unknown. The elucidation of these points seems to be difficult, because the phase diagram of an Fe—Pd based alloy is complicated, that is, the stoichiometric compositions, the eutectic phases, the intermediate phases, the ordered structures other than the stoichiometric compositions, e.g., PdFe and $FePd_3$ formed in a broad range of composition in the phase diagram, and, a magnetic transformation, order-disorder transformation and the like occur in the phase diagram. Another reason is that the Fe—Pd based alloy is easily oxidized.

The gas sensor and temperature sensor described above are indispensable in society, for various purposes, such as accident prevention and energy saving. Miniaturization and performance enhancement of such sensors are highly demanded, and such demands are rapidly increasing. Particularly, in recent years, accidents occur frequently involving many victims due to toxious gases, such as carbon monoxide and combustible gas. Not only carbon monoxide gas but also other dangerous gases such as hydrogen ($H_2$), ethanol ($C_2H_5OH$), methane ($CH_4$), isobutane ($iC_4H_{10}$) and butane ($C_4H_{10}$) may present an important problem to be solved along with the expanded use of city gas and industrial gas in the progress of modernization.

A catalytic combustion-type gas sensor has attracted attention in recent years, because of its quick and simple detection of a minor concentration of these toxic gases, its small size, easy handling, high reliability, fast response time, and relatively low price, as compared with another type of gas sensor based on the principle of chemical action.

A commercially available catalytic combustion-type CO gas sensor, in which pure platinum is used as the active detector, was tested by the present inventors. This attained 0.46 mV of ΔV at a 500 ppm of CO concentration. The output voltage ΔV was lower at a lower CO concentration, with the result that the S/N ratio was disadvantageously low. The CO detecting sensitivity is as low as approximately one-tenth or less that of the other gases, e.g., isobutane, and is hence very low. Output voltage variation at a specific gas-concentration is disadvantageously high. In addition to this disadvantage, a commercially available gas sensor responded to CO gas and another gas, which means poor selectivity of gases. Various disadvantages became therefore apparent in the case of a commercially available CO gas sensor. The reason was attributable to the small electrical resistance and small TCR of pure platinum. Another reason was in that, since strength of the pure platinum coil is low, it deforms during application of a catalyst paste thereon and hence the coil pitch varies, which in turn incurs non-uniform temperature distribution on the platinum coil during the current conduction.

A platinum coil must be very long so as to obtain high output voltage in the case of a commercially available CO gas sensor. This is the same in a commercially available temperature sensor. The diameter of a pure platinum coil used in the sensors must be as small as 20 $\mu$m or less because of the following reasons. In order to increase the output voltage $\Delta V$, $\Delta R$ must enough high, e.g., 45Ω.

When pure Pt having 10 $\mu\Omega$.cm of resistivity and Pd—Fe alloy having 50 $\mu\Omega$.cm of resistivity are compared with another, the wire diameter of the former must be smaller than the latter, and the winding number of the former must be greater than the latter as follows.

| | Pure Pt | Pd—Fe Alloy |
|---|---|---|
| Wire Diameter ($\mu$m) | 20 | 30 |
| Diameter of Coil (mm) | 0.8 | 0.8 |
| Winding Number (turn) | 45 | 20 |
| Resistance (Ω) | 15 | 15 |

It has been expected that these problems can be solved by utilizing a Pd—Fe base alloy having a higher TCR than platinum. However, since the operating temperature of the gas or temperature sensor is relatively high and, further, the oxidation resistance of the Pd—Fe alloy is relatively poor, the sensors involve problems in stability and deterioration of performance. The Pd—Fe alloy is, in addition, difficult to cold work into a fine wire.

The variance in the resistance and TCR in the catalytic combustion-type sensor are expressed, respectively, by equations (2) and (3).

$$\Delta R=\alpha\cdot TCR\ m\ Q/c \quad (2)$$

$$TCR=(R_{T2}-R_{T1})/(T2-T1)RT_1 \quad (3)$$

Here, $\Delta R$ is the value of a coil resistor (i.e., active resistor) changed due to the gas combustion, R is the resistance of a coil in the sensor, $\alpha$ is a constant determined by the kind of catalyst, m is the gas concentration, Q is the molecular combustion heat of the gas, and C is the heat capacity of a sensor. $R_{T1}$ and $R_{T2}$ are the electrical resistances at the respective temperatures T1 and T2, respectively. Therefore, the changed value of a coil resistor, $\Delta R$, becomes greater as the TCR is greater and the heat capacity is smaller with the proviso that the $\alpha$, m and Q are constant in equation (2). This in turn brings about an increase of the output voltage $\Delta V$ according to equation (1) and hence an increase in the gas sensitivity.

The following coefficient of thermal output performance can provide a base for evaluating how a gas- or temperature-sensor can be miniaturized $$\eta=\rho^2\times TCR \quad (4)$$

The properties of conventional resistor materials, such as pure platinum and thermistor, can therefore be evaluated based on the factors of equations (2) and (4). It can be said that these materials are advantageous according to several evaluations but are detrimental according to other evaluations.

The properties of a resistor material appropriate for gas- or temperature-sensor can be summarized as follows based on the considerations hereinabove.

(a) Average TCR is large.

(b) Resistivity $\rho$ is large.

(c) Coefficient of thermal output performance $\eta$, is large.

(d) Secular change or thermal hysteresis of electrical properties is small. When the electrical properties at temperature rise are different from those at temperature fall, that is, the resistor material has hysteresis, the sensitivity of a sensor device fluctuate. Problems in the performance of a sensor device may arise during long use.

(e) Has appropriate hardness Hv such as Fe—Pd alloy.

(f) Has chemical stability.

(g) Is difficult to oxidize.

(h) Has excellent formability so as to obtain a fine wire.

(i) Formability and workability of a coil is excellent.

(j) Is inexpensive.

(k) Variance or fluctuation in the properties (a) through (c) is small.

(l) Defect-free ingots can be obtained.

SUMMARY OF THE INVENTION

It is an object of the present invention to provide an novel electrical resistant alloy having improved TCR properties in a temperature range of from 0° to 500° C., more particularly from 0° to 200° C.

It is another object of the present invention to provide a method for producing a fine wire of the electrical resistant alloy.

It is a further object of the present invention to provide a novel sensor device satisfying the properties (a) through (l) mentioned above.

In accordance with an object of the present invention there is provided the following electrical resistant alloys (A) through (H).

(A) An electrical resistant alloy consisting, by atomic %, of from 5 to 65% of Fe, and from 0.001 to 20% in total, of at least one auxiliary component selected from the group consisting of 20% or less of Ni, 20% or less of Co, 20% or less of Ag, 20% or less of Au, 20% or less of Pt, 10% or less of Rh, 10% or less of Ir, 10% or less of Os, 10% or less of Ru, 10% or less of Cr, 5% or less of V, 5% or less of Ti, 5% or less of Zr, 5% or less of Hf, 8% or less of Mo, 5% or less of Nb, 10% or less of W, 8% or less of Ta, 3% or less of Ga, 3% or less of Ge, 3% or less of In, 3% or less of Be, 5% or less of Sn, 3% or less of Sb, 5% or less of Cu, 5% or less of Al, 5% or less of Si, 2% or less of C, 2% or less of B, and 5% or less of a rare earth element, the balance being essentially Pd and a minor amount of impurities, and said alloy having $4000\times10^{-6}$° C.$^{-1}$ or more of temperature coefficient of resistance in a temperature range of from 0° to 200° C.

(B) An electrical resistant alloy according to (A), wherein Co is selected as the first auxiliary component and at least one element other than Co is selected as the second auxiliary component.

(C) An electrical resistant alloy according to (A), wherein at least one element is selected from the group consisting of Ni, Ag, Au, Pt, Rh, Ir, Os, Ru, Cr, V, Ti, Zr, Hf, Mo, Nb, W, Ta, Ga, Ge, In, Be, Sn, Sb, Cu, Al, Si, C, B, and a rare earth element.

(D) An electrical resistant alloy consisting, by atomic %, of from 5 to 65% of Fe, from 0.001 to 20% of Mn, and from 0.001 to 20% in total of at least one auxiliary component selected from the group consisting of 20% or less of Ni, 20% or less of Co, 20% or less of Ag, 20% or less of Au, 20% or less of Pt, 10% or less of Rh, 10% or less of Ir, 10% or less of Os, 10% or less of Ru, 10% or less of Cr, 5% or less of V, 5% or less of Ti, 5% or less of Zr, 5% or less of Hf, 8% or less of Mo, 5% or less of Nb, 10% or less of W, 8% or less of Ta, 3% or less of Ga, 3% or less of Ge, 3% or less of In, 3% or less of Be, 5% or less of Sn, 3% or less of Sb, 5% or less of Cu, 5% or less of Al, 5% or less of Si, 2% or less of C, 2% or less of B, and 5% or less of a rare earth element, the balance being essentially Pd and a minor amount of impurities, and said alloy having $4000\times10^{-6}$° C.$^{-1}$ or more of temperature coefficient of resistance in a temperature range of from 0° to 200° C.

(E) An electrical resistant alloy according to (D), wherein Co is selected as the first auxiliary component and at least one element other than Co is selected as the second auxiliary component.

(F) An electrical resistant alloy according to (D), wherein at least one element is selected from the group consisting of Ni, Ag, Au, Pt, Rh, Ir, Os, Ru, Cr, V, Ti, Zr, Hf, Mo, Nb, W, Ta, Ga, Ge, In, Be, Sn, Sb, Cu, Al, Si, C, B, and a rare earth element.

(G) An electrical resistant alloy according to (A), (B), (C), (D), (E), or (F), wherein said alloy is in the form of a foil, a thin wire or a ribbon.

(H) An electrical resistant alloy according to (G), wherein said alloy is annealed in a temperature range of from 600° to 1300° C.

In accordance with another object of the present invention there is provided the following methods (I) through (K).

(I) A method for producing an electrical resistance alloy having 4000 or more of temperature coefficient of resistance in a temperature range of from 0° to 200° C., comprising the steps of:

melting in a non-oxidizing gas atmosphere, a reducing gas atmosphere or vacuum, one of the alloys (A) through (H);

casting a resultant melt;

working a material obtained by the casting; and, annealing said alloy in a temperature range of from 600° to 1300° C.

(J) A method according to (I), wherein said working step comprises hot working and cold working.

(K) A method according to (J), wherein said annealing is carried out by continuous annealing.

In accordance with a further object of the present invention there is provided the following catalytic combustion type sensors (L) through (W).

(L) A catalytic combustion-type gas sensor, comprising a bridge circuit, which comprises a standard resistor to be in contact with the gas to be measured, and an active resistor to be contact with the gas to be measured and provided with a catalytic layer, wherein said standard resistor and said active in contact with the gas to be measured, and an active resistor to be contact with the gas to be measured and provided with a catalytic layer, wherein said standard resistor and said active resistor consist of one of the alloys (A) through (H).

(M) A catalytic combustion-type gas sensor according to (L), wherein said standard resistor and said active resistor are in the form of a foil, a thin wire or a ribbon.

(N) A catalytic combustion-type gas sensor according to (M), wherein at least one of said standard resistor and said active resistor is provided with a coating of metal, resin or inorganic compound on the surface thereof.

(O) A catalytic combustion-type gas sensor according to (M), wherein said standard resistor and said active resistor are in the form of a film formed on an electrically insulating substrate.

(P) A catalytic combustion-type gas sensor according to (O), wherein said film is formed by electro-deposition, vapor deposition, ion plating or sputtering.

(Q) A catalytic combustion-type gas sensor according to (P), wherein said film is delineated by photo-etching or trimming.

(R) A catalytic combustion-type gas sensor according to (L) through (Q), wherein said gas to be measured is one gas selected from the group consisting of carbon monoxide, hydrogen, ethanol, methane, isobutane and butane.

(S) A catalytic combustion-type gas sensor according to (L) through (R), wherein said standard resistor is provided with a coating which comprises at least one compound selected from the group consisting of $SiO_2$, $Ni_2O_3$, $Al_2O_3$, CuO, $Cr_2O_3$ and $TiO_2$.

(T) A catalytic combustion-type gas sensor according to (L) through (R), wherein said catalytic layer comprises at least one member selected from the group consisting of Pt black, PdO, $Al_2O_3$, $Cu_2O$, ZnO, $MnO_2$, $Sm_2O_3$, and $Rh_2O_3$.

The present invention is hereinafter described with reference to the drawings.

DESCRIPTION OF PREFERRED EMBODIMENTS

In the electrical resistant alloys (A) through (H) of the present invention, the Fe content is limited to a range of from 5 to 65 at %, because outside this range of Fe content, the electrical properties are impaired, although neither oxidation resistance nor formability is impaired.

The electrical properties at a high temperature are particularly improved in a high Fe content of from 35 to 65 at %.

In the electrical resistant alloys (D) through (H), Mn is added to further improve the electrical properties, the formability and the oxidation resistance. The Mn content is limited to a range of from 0.001 to 20 at % to ensure a high level of electrical properties, formability and oxidation resistance.

The auxiliary components of the electrical resistant alloys (A) through (C) are described with reference to FIGS. 3 through 5. As is apparent from these drawings, the auxiliary components, i.e., Ni, Co, Ag, Au, Pt, Rh, Ir, Os, Ru, Cr, V, Ti, Zr, Hf, Mo, Nb, W, Ta, Ga, Ge, In, Be, Sn, Sb, Cu, Al, Si, C, B and a rare-earth element (Sc, Y and lanthanum elements) improve TCR and resistivity. The auxiliary elements also improve the formability of the Pd—Fe alloy. When the content of the auxiliary components is kept within the ranges described in the item (A), not only the electrical properties are improved, but also the formability is greatly improved. The improvement in the formability is a synergistic effect of grain-refinement, enhancement of melt-flowability and suppression of oxidation.

Figure 3:
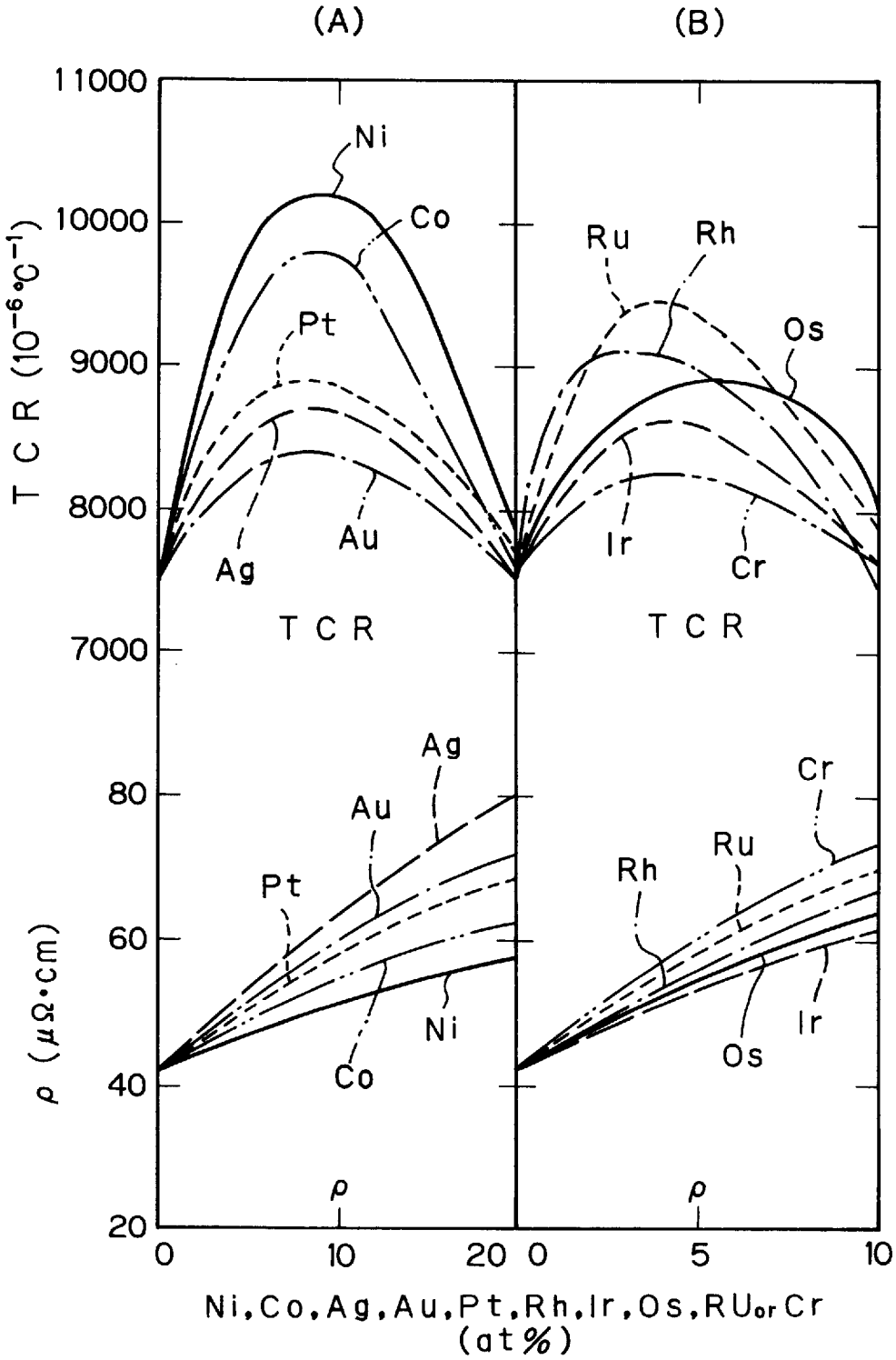
FIG. 3 includes graphs (A) and (B) showing relationships of resistivity ρ and TCR of Pd—33%Fe—Me (Me=Ni, Co, Ag, Au, Pt, Rh, Ir, Os, Ru or Cr) alloy with respect to the Me concentration.
Figure 4:
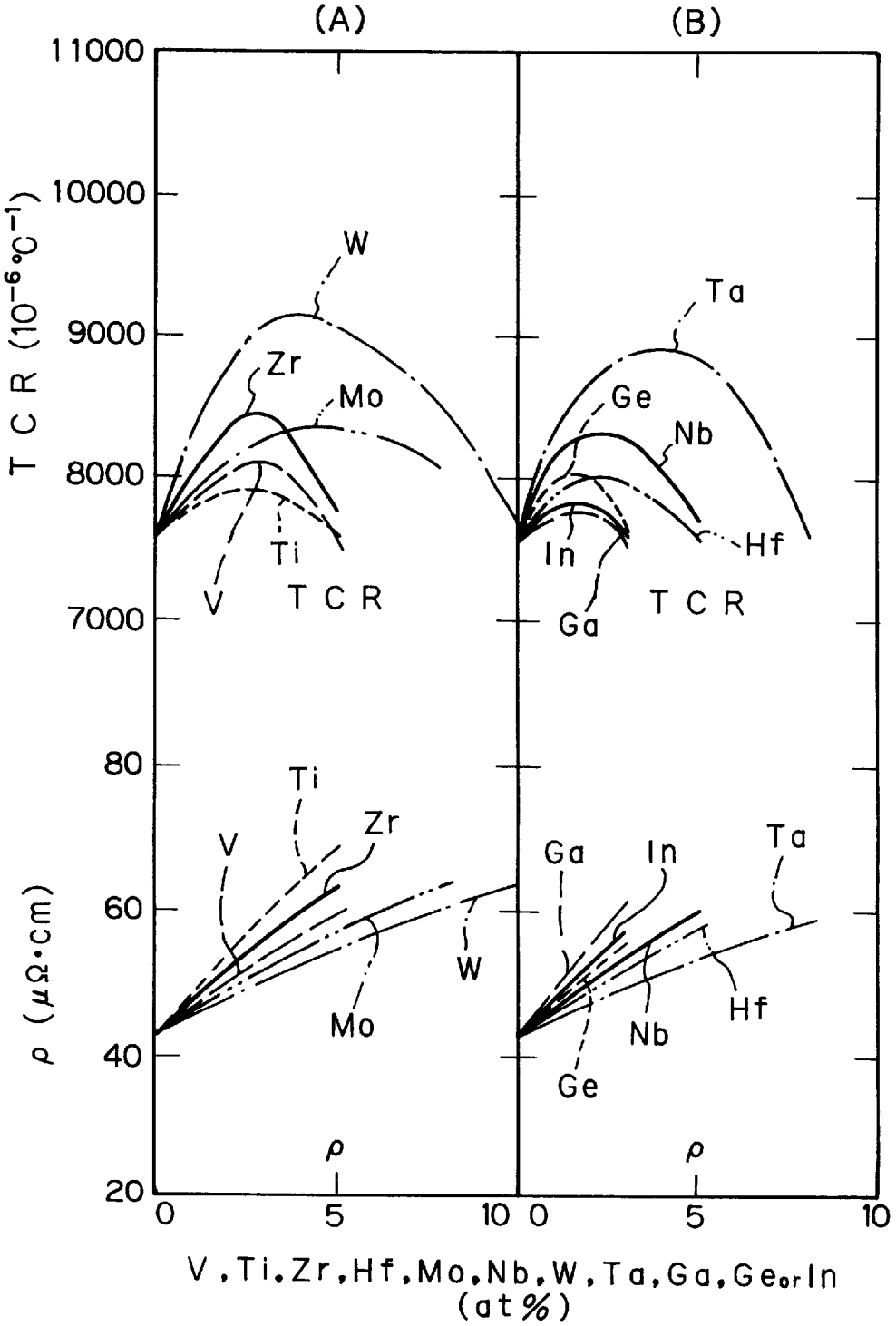
FIG. 4 includes graphs (A) and (B) showing relationships of resistivity ρ and TCR of Pd—33%Fe—Me (Me=V, Ti, Zr, Hf, Mo, Nb, W, Ta, Ga, Ge or In) alloy with respect to the Me concentration.
Figure 5:
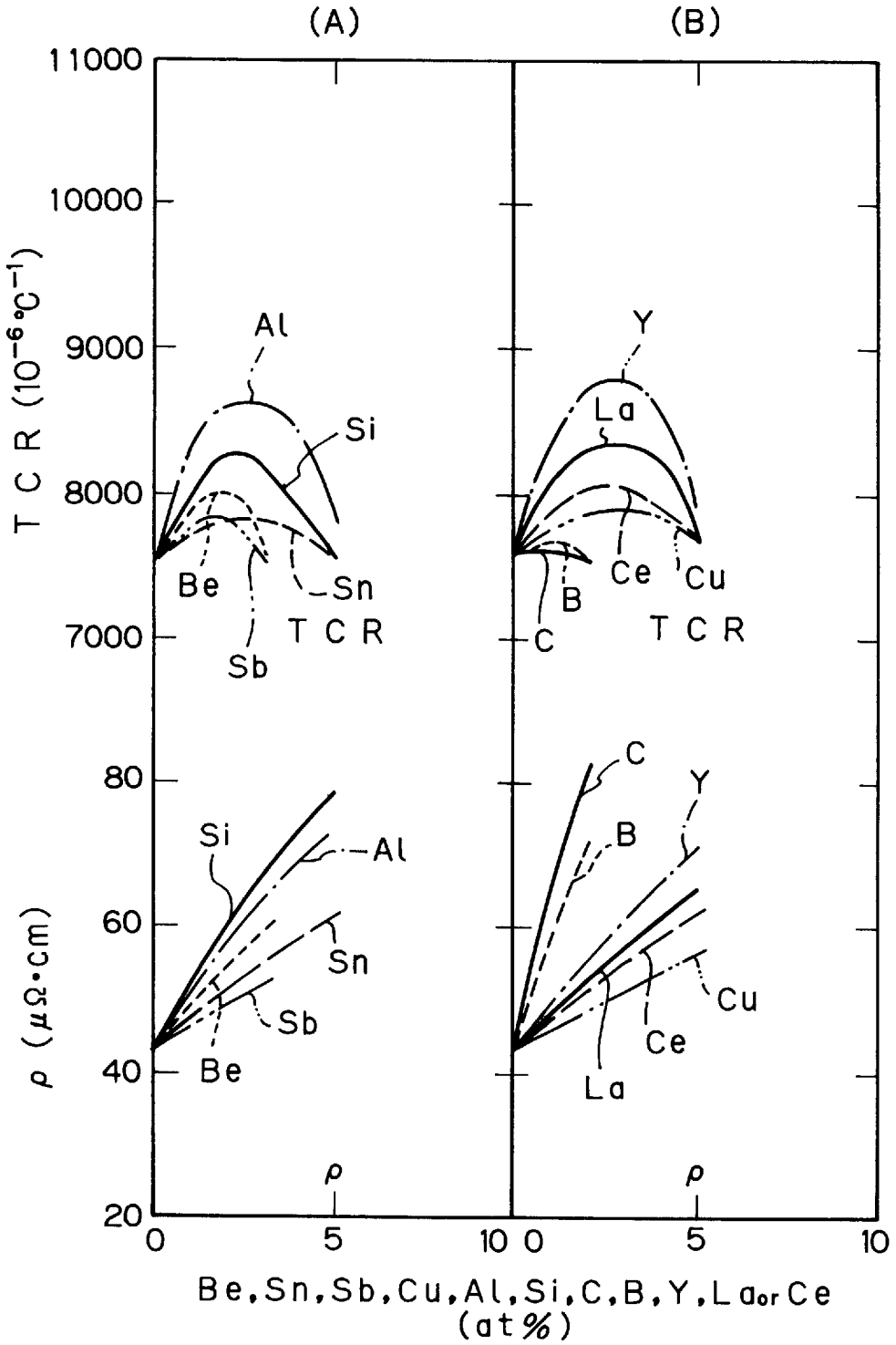
FIG. 5 includes graphs (A) and (B) showing relationships of resistivity ρ and TCR of Pd—33%Fe—Me (Me=Be, Sn, Sb, Cu, Al, Si, C, B, Y, La or Ce) alloy with respect to the Me concentration.

FIGS. 3 through 5 indicate TCR and resistivity ρ of a Pd—33% Fe—alloy with an auxiliary component. TCR and resistivity ρ are measured in a temperature range of from 0° to 200° C. The Pd—33%Fe—Me alloy, whose content of the auxiliary component is shown in FIGS. 3 through 5, was in the form of a wire 0.03 mm in diameter and continuously annealed at 1000° C. in hydrogen atmosphere and at 2 m/min of conveying speed.

FIGS. 3 through 5 show preferable content and upper limit of the auxiliary elements as follows.

(1) FIG. 3 (A): preferable content of Ni, Pt, Ag, Co or Au—from about 4 to 12 at %, and the upper limit of Ni, Pt, Ag, Co or Au—20 at %.

Co enhances the magnetic transformation point and hence greatly improves the electrical properties at a high temperature.

Co is therefore selected as the first auxiliary component in the electrical resistant alloy (B) mentioned above. However, TCR is impaired, in addition, the formability is also impaired at a Co content exceeding 20%. Also, TCR and the formability are impaired at an Ni content exceeding 20%.

(2) FIG. 3 (B): preferable content of Rh, Ir, Os, Ru or Cr—from about 3 to 8 at %, and the upper limit of Rh, Ir, Os, Ru or Cr—10 at %.

The contents of Rh, Ir, Os and Ru are limited as above for the same reasons as described for Co and Ni. The Cr content of 10% or less is effective for forming a continuous oxide layer which prevents further oxidation. Such Cr content is considerably effective for grain-refinement and hence for improving formability. Flowability of melt and formability are seriously impaired at a Cr content higher than 10%.

(3) FIG. 4(A): preferable content of V, Ti, or Zr—from about 2 to 4 at %; preferable content of Mo and W from about 2 to 7 at %; the upper limit of V, Ti or Nb—5 at %; upper limit of Mo 8 at %; and the upper limit of W—10 at %.

Such elements as V, Ti, Nb and W have functions as described for Cr. The contents of V, Ti, Nb and W are limited as above for the reasons described for Cr.

(4) FIG. 4(B): preferable content of Hf or Nb—from about 2 to 3 at %; preferable content of Ta—from about 2 to 5 at %; preferable content of Ga, Ge or In—from about 1 to 2 at %; the upper limit of Hf—5 at %; the upper limit of Ta—8 at %; and the upper limit of Ga, Ge, In or Be—3 at %.

Ta, Zr and Hf have functions as described for Cr. The contents of Ta, Hf, Ga, Ge, In and Be are limited as above for the reasons described for Cr.

(5) FIG. 5(A): preferable content of Sn, Al, Si, or Cu—from about 3 to 4 at %; preferable content of Sb or Be—from 1 to 2 at %; the upper limit of Sn—5 at %; the upper limit of Cu, Al, Si—5 at %, and the upper limit of Sb—3 at %.

Sn at content of 5% or less and Sb at content of 3% or less are effective for forming a continuous oxide layer which prevents further oxidation. Cr and Sb at such contents are considerably effective for grain-refinement and hence for improving formability. Cu, Si and Al have these effects and also improve the flowability of melt, when their contents are limited as above. The contents of Cu, Si and Al described above are effective for suppressing the oxidation and improving the formability.

Cu, Si and Al at 5% or less are effective for grain-refinement, improving of melt-flowability and formability, and suppressing the oxidation.

(6) FIG. 5(A): preferable content of Cu, Y, La, and Ce—from about 2 to 4%; preferable content of B or C—from about 0.5 to 1.5 at %; the upper limit of Y, La, and Ce—5 at %; and the upper limit of B or C—from about 2 at %.

Such elements as C, B and a rare earth element have functions as described for Cu, Si and Al. The contents of C, B and a rare earth element are limited as above for the reasons described for Cu, Si and Al.

The auxiliary components of the electrical resistant alloys (D) through (E) mentioned above are described with reference to FIGS. 6 through 8. As is apparent from these drawings, the auxiliary components, i.e., Ni, Co, Ag, Au, Pt, Rh, Ir, Os, Ru, Cr, V, Ti, Zr, Hf, Mo, Nb, W, Ta, Ga, Ge, In, Be, Sn, Sb, Cu, Al, Si, C, B and a rare-earth element (Sc, Y and lanthanum elements) improve TCR, resistivity ρ, and formability. The improvement in the formability is a synergistic effect of grain-refinement, enhancement of melt-flowability and suppression of oxidation.

Figure 6A:
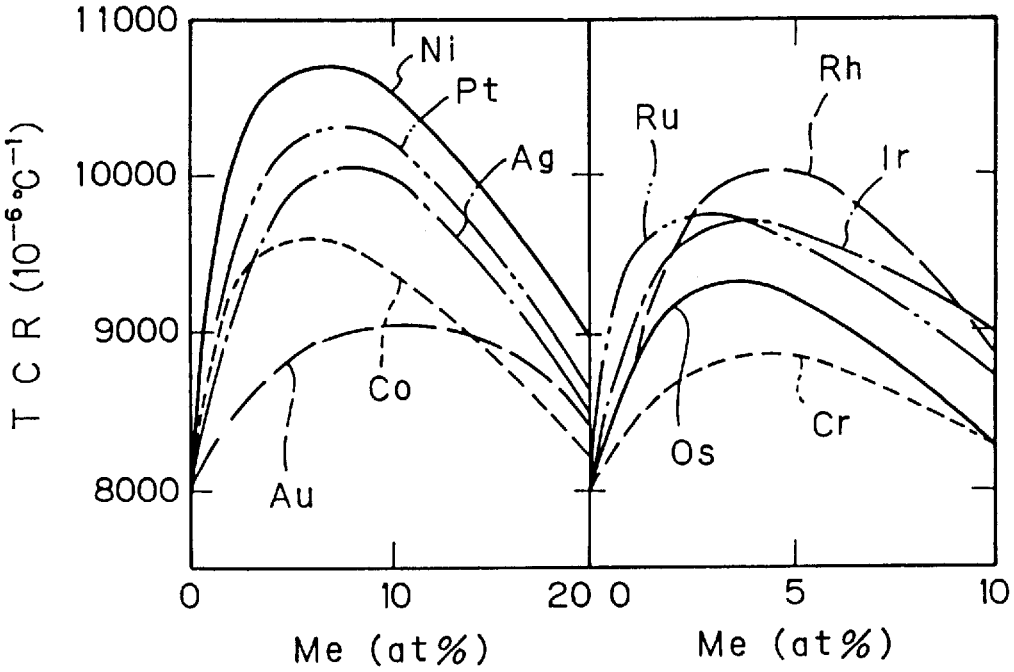
FIG. 6 includes graphs (A) and (B) showing relationships of resistivity ρ and TCR of Pd—25%Fe—5%Mn—Me (Me=Ni, Co, Ag, Au, Pt, Rh, Ir, Os, Ru or Cr) with respect to the Me concentration.
Figure 6B:
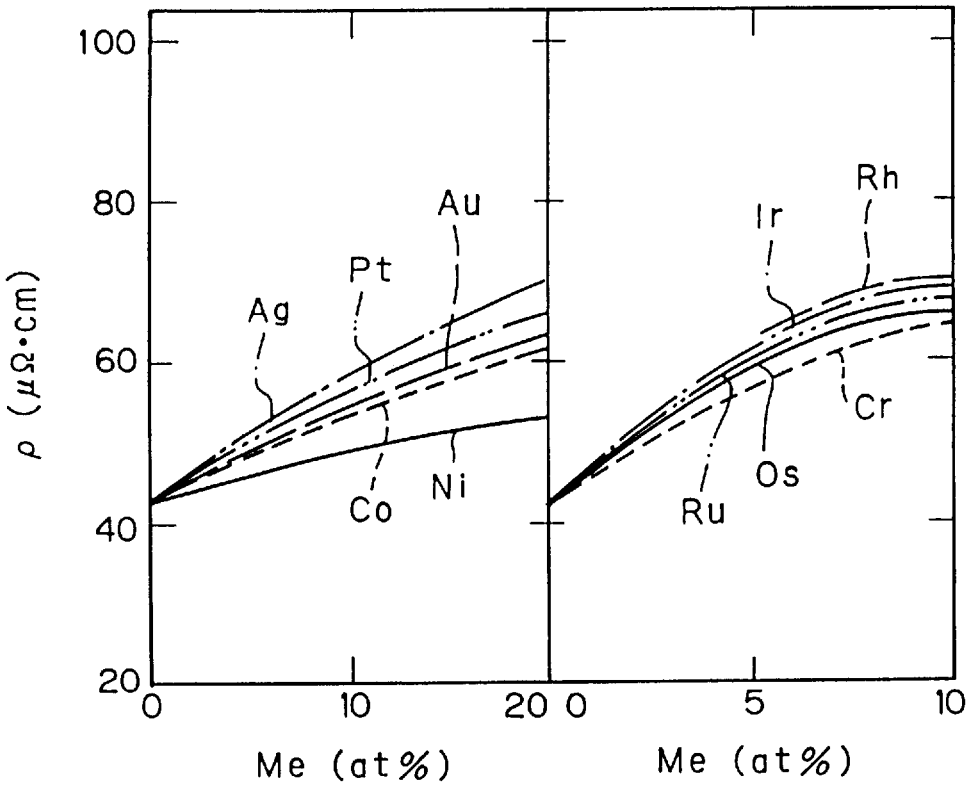
Figure 7A:
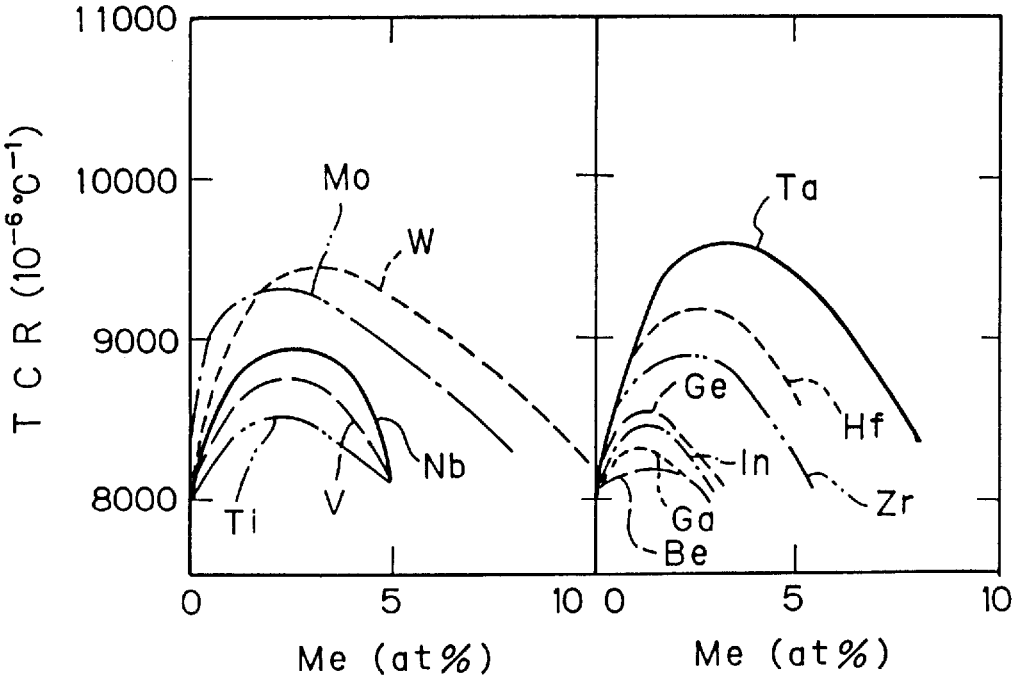
FIG. 7 includes graphs (A) and (B) showing relationships of resistivity ρ and TCR of Pd—25%Fe—5%Mn—Me (Me=V, Ti, Mo, Nb, W, Ta, Ga, Ge, In, Be, Zr or Hf) with respect to the Me concentration.
Figure 7B:
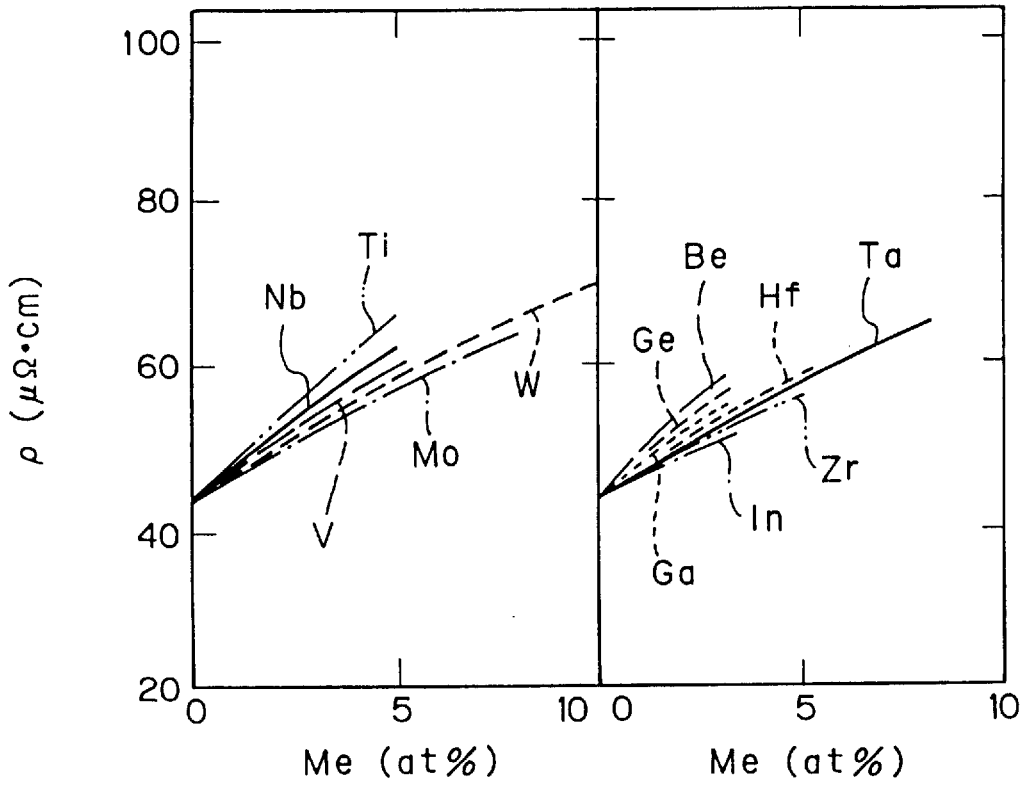
Figure 8A:
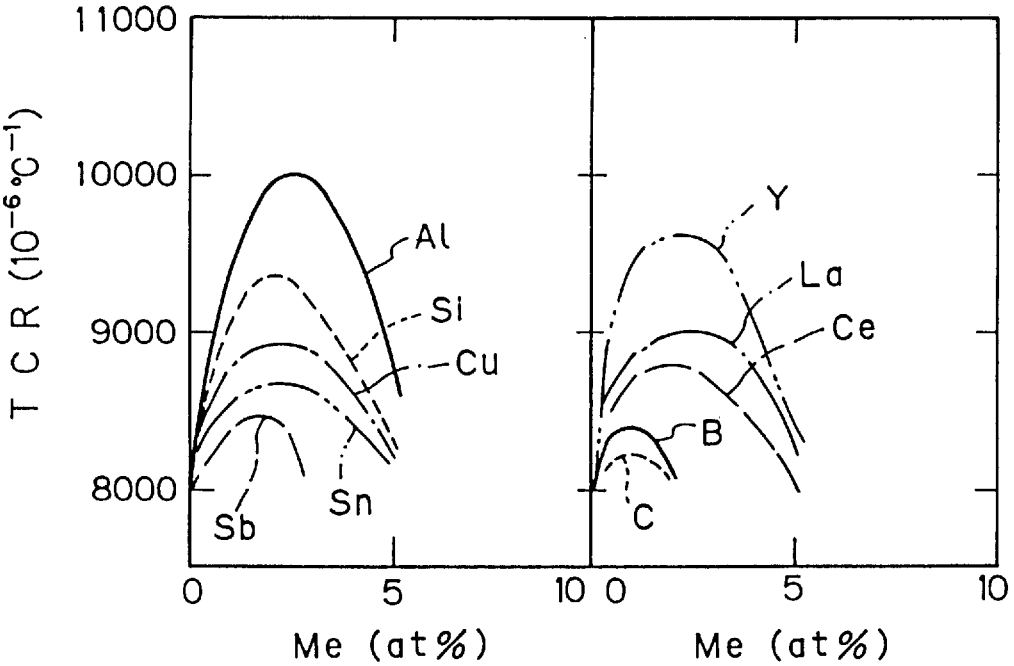
FIG. 8 includes graphs (A) and (B) showing relationships of resistivity ρ and TCR of Pd—25%Fe—5%Mn—Me (Me=Sn, Sb, Cu, Al, Si, Ce and La) with respect to the Me concentration.
Figure 8B:
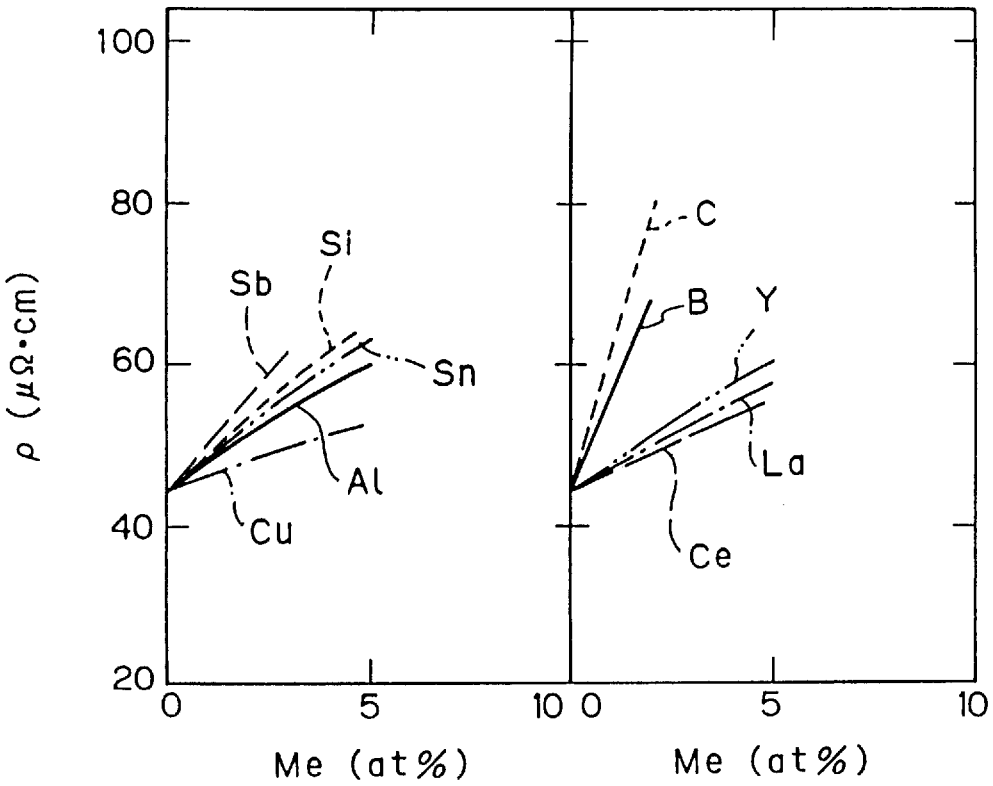

FIGS. 6 through 8 indicate TCR and resistivity ρ of a Pd—25% Fe—5% Mn—Me alloy. TCR and resistivity ρ are measured in a temperature range of from 0° to 200° C. This alloy has been treated by the same method as the Pd 33% Fe—Me alloy.

(7) FIG. 6 (A): preferable content of Ni, Pt, Ag, Co or Au—from about 3 to 9 at %, and the upper limit of Ni, Pt, Ag, Co or Au—20 at %.

Since Co enhances the magnetic transformation point and hence greatly improves the electrical properties at a high temperature, Co is selected as the first auxiliary component in alloy (E).

The reasons for limiting the Ni, Pt, Ag, Co and Au contents are the same as in item (1), above.

(8) FIG. 6 (A): preferable content of Rh, Ir, Os, Ru or Cr—from about 3 to 8 at %; and the upper limit of Rh, Ir, Os, Ru or Cr—10 at %.

The contents of Pt, Ag, Au, Rh, Ir, Os and Ru are limited as above for the same reasons as described in item (2) above.

(9) FIG. 7 (A): preferable content of V, Ti or Nb—from about 2 to 4 at %, preferable content of Mo from about 2 to 7 at %; preferable content of W—from 2 to 7 at %; the upper limit of V, Ti or Nb—5 at %; the upper limit of Mo 8 at %; and the upper limit of W—10 at %.

The contents of V, Ti, Nb and W are limited as above for the reasons described in item (3), above.

(10) FIG. 7(A): preferable content of Zr or Hf—from about 2 to 3 at %; preferable content of Ta—from about 2 to 5 at %; preferable content of Ga, Ge, In or Be—from about 1 to 2 at %; the upper limit of Zr or Hf—5 at %; the upper limit of Ta—8 at %; the upper limit of Ga, Ge, In or Be—3 at %.

The contents of Ta, Zr, Hf, Ga, Ge, In and Be are limited as above for the reasons described item (4), above.

(11) FIG. 8(A): preferable content of Sn, Al, Si or Cu—from about 3 to 4 at %; preferable content of Sb—from 1 to 2 at %; the upper limit of Sn, Al, Si or Cu—5 at %, and the upper limit of Sb—3 at %.

The contents of Sn, Al, Si and Cu are limited for the reasons described in item (5), above.

(12) FIG. 8(A): preferable content of Y, La, and Ce—from about 2 to 4%; preferable content of B or C—from about 0.5 to 1.5 at %; the upper limit of Y, La, and Ce—5 at %; and the upper limit of B or C—2 at %.

The contents of Y, La, Ce, C, B and a rare earth element are limited as above for the reasons described in item (6).

An electrical resistant alloy according to the present invention (No. 210 mentioned below) was formed into a wire having a diameter of 0.03 mm and was annealed in a continuous annealing furnace having a heating zone and cooling zone with appropriate length. The wire was conveyed into the continuous annealing furnace at a conveying speed (V) indicated in the ordinate of FIG. 9. The annealing was carried out in a hydrogen atmosphere at a temperature (T) indicated in the abscissa of FIG. 9. As is apparent from FIG. 9, very high TCR can be obtained by appropriately selecting the conveying speed (V) and the heat-treatment temperature (T).

Figure 9:
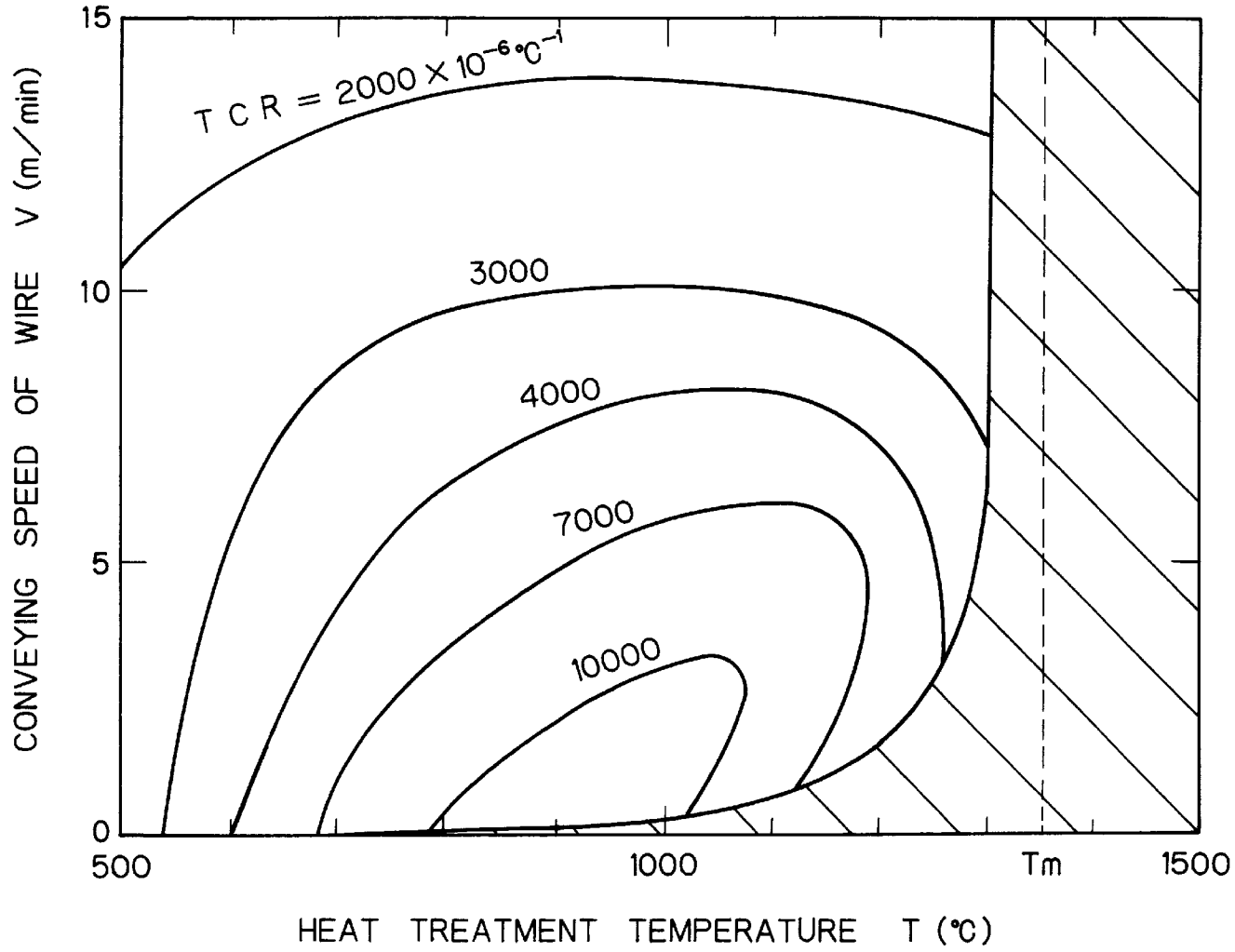
FIG. 9 is a graph showing the relationship of TCR of Alloy No. 210 and the heat-treatment temperature.

Similar curves as shown in FIG. 9 were obtained with regard to the Pd—34% Fe—5% Ni—3% Rh alloy.

According to an embodiment of the present invention, based on the discoveries involved in FIG. 9, the material of the standard and/or active resistors is annealed at a temperature in a range of from 600° to 1300° C., thereby enhancing TCR and resistivity ρ. The annealing in this temperature range decreases the hardness to a level lower than Hv 400, with the result that the formability is further improved.

According to another embodiment of the present invention, TCR in a range of from 7000–10000×$10^{-6}$° C.$^{-1}$ can be attained by continuous annealing at a temperature of from about 800° to 1000° C. and conveying speed of from 2.5 meter/minute or less.

Figure 10:
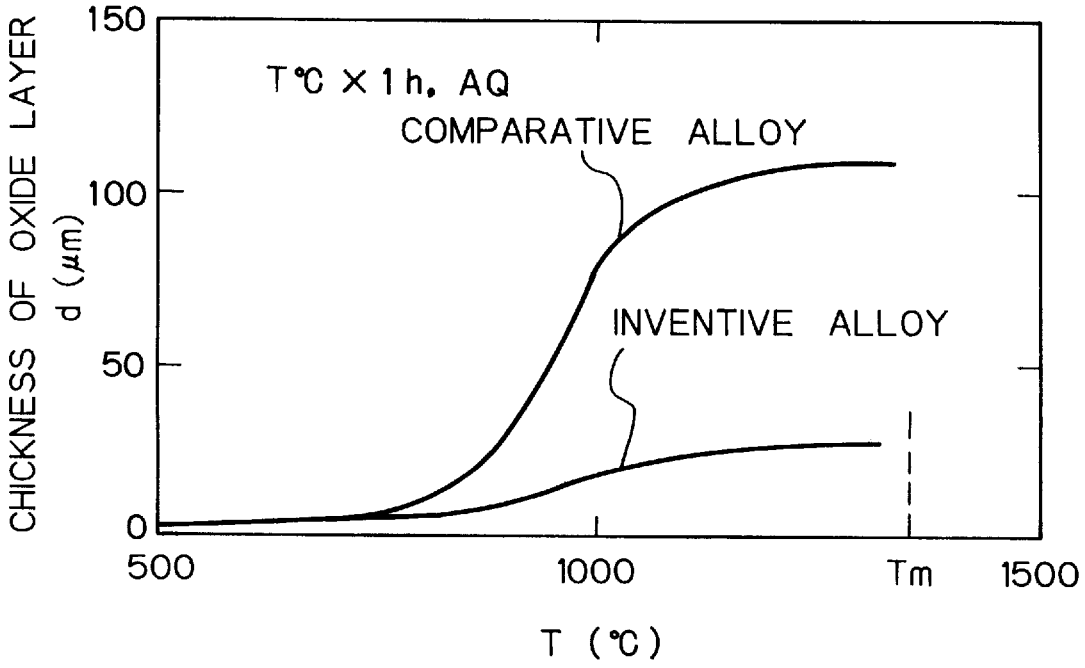
FIG. 10 is a graph showing the relationship of the thickness (d) of the oxide layer of the inventive alloy (Alloy No. 98) and a comparative alloy (Pd—30%Fe—5% Mn) with respect to the heat-treatment temperature (T).
Figure 11:
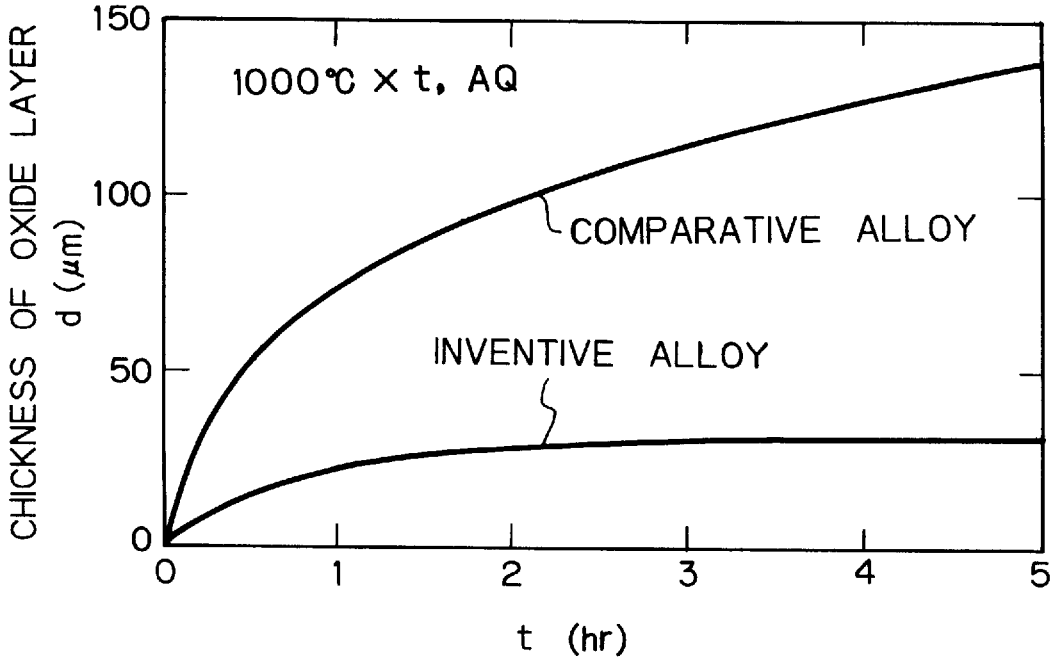
FIG. 11 is a graph showing the relationship of the thickness (d) of the oxide layer of the inventive alloy (Alloy No. 210) and a comparative alloy (Pd—30%Fe—5% Mn) with respect to the heat-treatment time.

An electrical resistant alloy according to the present invention (No. 98 mentioned below) and a comparative alloy (Pd—33% Fe) were formed into a wire having a diameter of 0.5 mm and were then held in ambient air up to 1000° C. for 1 hour (FIG. 10) or at 1000° C. for up to 5 hours (FIG. 11). The wires were then subjected to observation by an optical microscope so as to determine the thickness of the oxide layer.

The increase in the oxide layer's thickness of comparative alloy (FIG. 11) proceeds with the holding time and conforms to a $t^{1/2}$ rule. The increase of the oxide layer's thickness (d) inventive alloy (FIG. 11) conforms to a $t^{1/3}$ rule. That is, the thickness (d) of the inventive alloy rapidly increases at the initial holding time but keeps an almost constant value at a holding time of approximately 2 hours or longer. This indicates that a continuous oxide layer is formed on the surface of the inventive alloy at the initial holding time and suppresses subsequent oxidation.

Similar curves as shown in FIG. 10 and 11 were obtained with regard to the Pd—25% Fe—5% Mn—5% Ni—5% Pt alloy (No. 210 mentioned below).

According to a preferred embodiment of the present invention, based on the discovery shown in FIGS. 10 and 11, the electrical resistance alloys according to the present invention have a continuous oxide layer having a thickness of from 0.01 to 10 μm, more preferably from 0.05 to 5 μm. This oxide layer prevents the core part of a filament, strip, wire or the like from oxidation, when a sensor is operated at a temperature higher than 200° C. Since the oxide layer is very thin, it exerts no detrimental effect what ever on the TCR and resistivity characteristic of the inventive alloys.

According to another preferred embodiment of the present invention, a protective coating is formed on the filament, strip, wire or the like consisting of the inventive alloy, so as to prevent its oxidation. The protective coating may consist of a resin such as polyimide or phenol, a metal such as gold or chromium, or an inorganic compound such as metal oxide or glass. Thickness of the protective layer is preferably from 0.05 to 5 μm. The protective layer prevents the electrical resistant alloy from oxidation during the gas- or temperature-sensing and can realize the sensing with high sensitivity.

The flowability of a Pd—Fe—(Mn)—Me melt was investigated in a casting process. Materials from 100 to 300 g in weight were melted in a high-frequency induction furnace, and poured into ingots. Metal flow into the metallic ingot case, the metal amount left in the crucible, and defects on the ingots resulting from metal-flow failure were observed. The alloys with the addition of Ni, Co, Rh, Au, Ga, In, Sn, Sb, Cu, Si or B exhibited more remarkably improved flowability than with other auxiliary elements.

The auxiliary component(s) generally refines the crystal grains of a Pd—Fe—(Mn)—Me alloy. Particularly, the auxiliary components except for Ni, Co, Rh, Ga, In, Sn, Sb are effective for the grain refinement.

The ingots obtained were forged. Forgeability was good, that is, a small-diameter rod, which is to be subjected to wire drawing, was obtained in a high yield. Since the hot- and cold-formability of the Pd—Fe—(Mn)—Me alloys are improved by the auxiliary elements, the forming process can be simplified and/or omitted such that the number of forging and drawing operations can be reduced.

Figure 12:
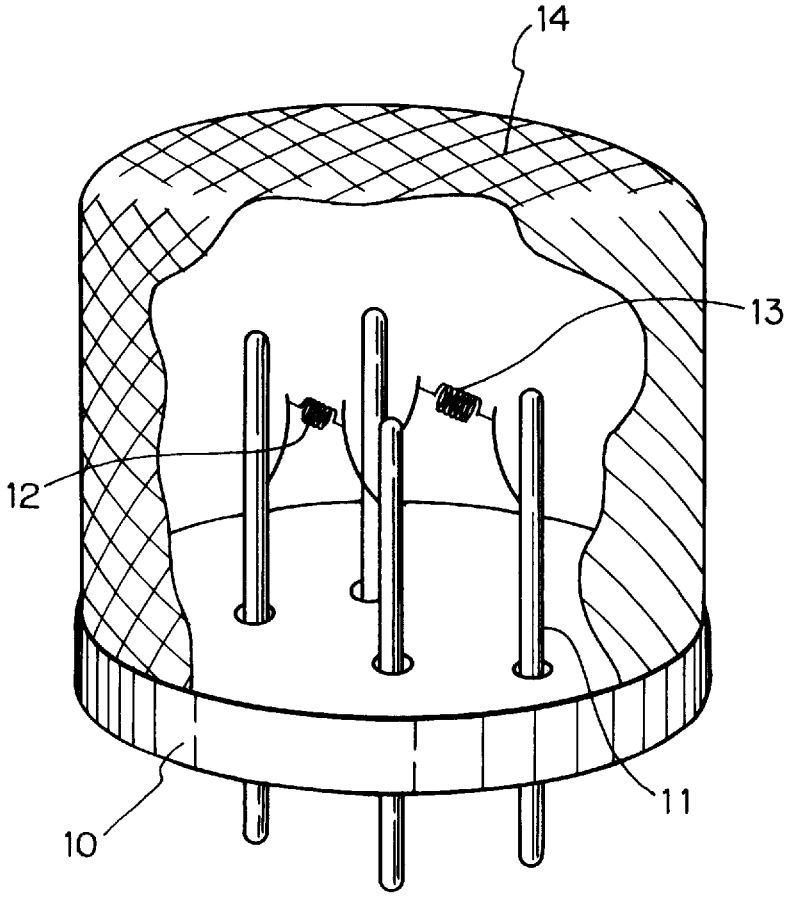
FIG. 12 illustrates a trial-produced CO gas sensor having improved sensitivity (two components).

Referring to FIG. 12, an embodiment of a gas- or temperature sensor is illustrated. Four stems 11 protrude through a hermetic substrate 10 and the active component 12 and the standard or compensating component 13 are connected between each pair of stems 11. These components 12 and 13 and the stems 11 are surrounded by a mesh cover 14.

The present invention is hereinafter described by way of examples.

EXAMPLE 1

The materials used to produce an example of the Pd—Fe—auxiliary component alloy (No. 107) containing 34% of Fe, 5% of Ni, and 3% of Rh, had 99.9% or more purity. The materials 300 g in weight were loaded in an alumina crucible and melted in a high-frequency induction furnace under vacuum. The resultant melt was then thoroughly stirred in the alumina crucible to attain uniformity in the melt. The melt was then poured into a metal mold, whose cavity was 12 mm in diameter and 200 mm in height. The resultant ingot in the form of a round rod was hot-forged and cold-formed by means of a swaging machine and a wire cold-drawing machine, so as to obtain a 0.5 mm diameter wire. The total reduction of area during the cold working is given in Table 1, below. This wire was subjected to various heat treatments under the conditions given in Table 1 and then air cooled. The so-treated wire was used as samples for tests.

The samples had a metallic luster except for the samples heat treated in the air atmosphere. The samples were about four to five times as hard as the pure platinum.

Figure 13:
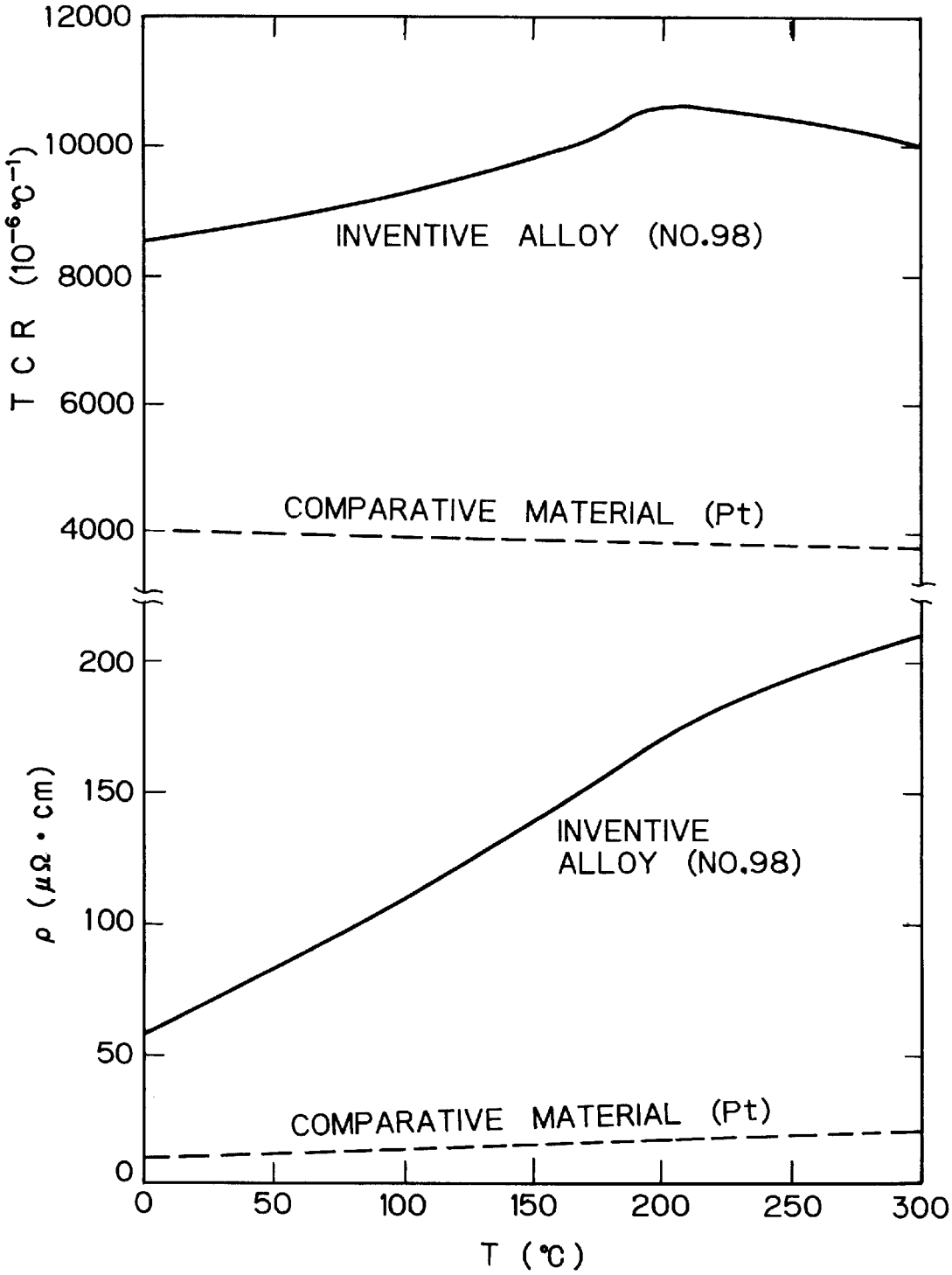
FIG. 13 includes graphs showing the TCR—T (temperature) characteristic and resistivity ρ—T characteristic of an inventive alloy (Alloy No. 98) and a comparative material (platinum).

TCR and resistivity ρ of the sample versus temperature (T) are shown in the upper half and lower half of FIG. 13, respectively. The TCR-T characteristic exhibits a peak at a temperature which is coincident with the magnetic transforming point (Tc) of the alloy. The electrical properties at high temperature can be improved by raising the Tc.

TABLE 1

| Cold Working (%) | Heat Treatment: Temperature (°C.) | Heat Treatment: Time (min) | Heat Treatment: Atmosphere | Resistivity ρ: 0° C. | Resistivity ρ: 200° C. | TCR | Hardness (Hv) | Surface |
|---|---|---|---|---|---|---|---|---|
| 90 | — | — | — | 32 | 58.2 | 4250 | 470 | Fine wrought structure |
| 90 | 800 | 30 | air | 51 | 139.2 | 8680 | 260 | Slightly oxidized Light gray |
| 90 | 1000 | 60 | air | 53 | 162.2 | 10300 | 190 | Uniform oxide film |
| 70 | 800 | 120 | Hydrogen | 51 | 139.2 | 8930 | 265 | Metallic luster |
| 70 | 1000 | 60 | Hydrogen | 55 | 171.6 | 10600 | 200 | Metallic luster |
| 70 | 1200 | 30 | Hydrogen | 52 | 161.2 | 10500 | 185 | Metallic luster |
| 80 | 800 | 120 | Argon | 49 | 135.8 | 8860 | 265 | Slightiy oxidized Light gray |
| 80 | 1000 | 120 | Argon | 49 | 135.8 | 8860 | 265 | Slightly oxidized Light gray |

Remarks: TCR is in $10^{-6\circ}$ C.$^{-1}$. Resistivity is $\mu\Omega \cdot$ cm.

EXAMPLE 2

The production process of Example 1 was repeated for treating the inventive alloys Nos. 98, 100, 105, 109, 112 and 117 given in Table 2. TCR in the temperature ranges of from 0° to 200° C., from 0° to 300° C., from 0° to 400° C. and from 0° to 500° C. are given in Table 2.

TABLE 2

| Alloy No. | Composition (at %) Fe | Auxiliary components | TCR ($10^{-6}$° C.$^{-1}$) 0–200° C. | 0–300° C. | 0–400° C. | 0–500° C. |
|---|---|---|---|---|---|---|
| 98 | 34 | Ni = 5, Rh = 3 | 10600 | — | — | — |
| 100 | 40 | Ru = 2, Y = 1 | 9900 | 11000 | — | — |
| 105 | 48 | Ta = 2, Hf = 0.5 | 9300 | 10350 | 10450 | — |
| 109 | 50 | Cr = 2, Co = 9 | 8800 | 9750 | 10750 | 11800 |
| 112 | 55 | W = 3, Nb = 1 | 7950 | 8800 | 9700 | — |
| 117 | 60 | Pt = 2, Si = 0.5 | 7500 | 8300 | 9150 | — |

Figure 14:
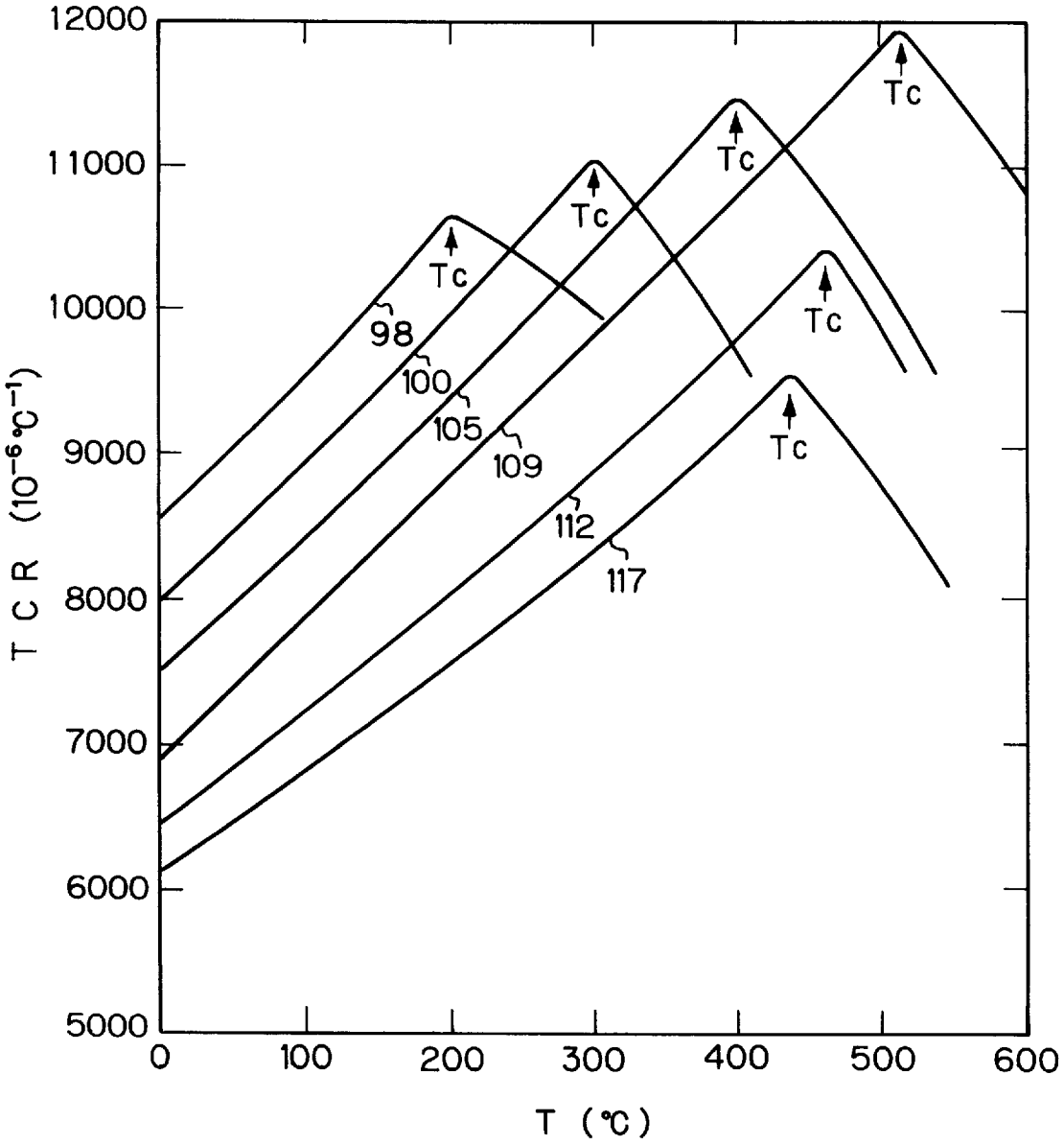
FIG. 14 shows TCR—T curves of Alloy Nos. 98, 100, 105, 109, 112 and 117.

The TCR-T characteristic of the samples is shown in FIG. 14. It is apparent that TCR exhibits a peak at the magnetic transformation point ($T_c$).

EXAMPLE 3

An alloy (No. 210), which contained 25% of Fe, 5% of Mn, 5% of Ni and 5% of Pt, the balance being Pd and impurities, was melted, formed and heat-treated by the same methods as in Example 1. The resistivity ρ, TCR, hardness and surface condition of the samples are shown in Table 3.

TABLE 3

| Cold Working (%) | Heat Treatment Temperature (°C.) | Time (min) | Atmosphere | Resistivity ρ 0° C. | 200° C. | TCR | Hardness (Hv) | Surface |
|---|---|---|---|---|---|---|---|---|
| 95 | — | — | — | 30 | 57 | 4580 | 450 | Fine wrought structure |
| 95 | 800 | 30 | air | 48 | 130 | 8520 | 270 | Liqht gray |
| 90 | 1000 | 60 | air | 52 | 165 | 10900 | 200 | Uniform oxide film |
| 75 | 800 | 120 | Hydrogen | 46 | 127 | 8760 | 275 | Metallic luster |
| 75 | 1000 | 60 | Hydrogen | 50 | 162 | 11160 | 205 | Metallic luster |
| 75 | 1200 | 30 | Hydrogen | 51 | 160 | 10730 | 195 | Metallic luster |
| 85 | 800 | 120 | Argon | 47 | 128 | 8640 | 277 | Slightly oxidized Light gray |
| 85 | 1000 | 60 | Argon | 51 | 161 | 10810 | 203 | Slightly oxidized Light gray |

EXAMPLE 4

The production process of Example 1 was repeated for treating the inventive alloys Nos. 210, 213, 225, 232 and 246 given in Table 4. TCR in the temperature ranges of from 0° to 200° C., from 0° to 300° C., from 0° to 400° C. and from 0° to 500° C. are given in Table 2.

TABLE 4

| Alloy No. | Composition (at %) Fe | Mn | Auxiliary components | TCR ($10^{-6}$° C.$^{-1}$) 0–200° C. | 0–300° C. | 0–400° C. | 0–500° C. |
|---|---|---|---|---|---|---|---|
| 210 | 34 | 5 | Ni = 5, Pt = 5 | 10900 | — | — | — |
| 213 | 42 | 7 | Pt = 2, Zr = 1 | 9850 | 11150 | — | — |
| 225 | 47 | 4 | Ge = 2, Cr = 2 | 8850 | 10050 | 10400 | — |
| 232 | 52 | 3 | Ru = 2, Co = 10 | 8100 | 9100 | 10250 | 11600 |
| 246 | 60 | 8 | W = 3, Nb = 1 | 7700 | 8750 | 9850 | — |

Figure 15A:
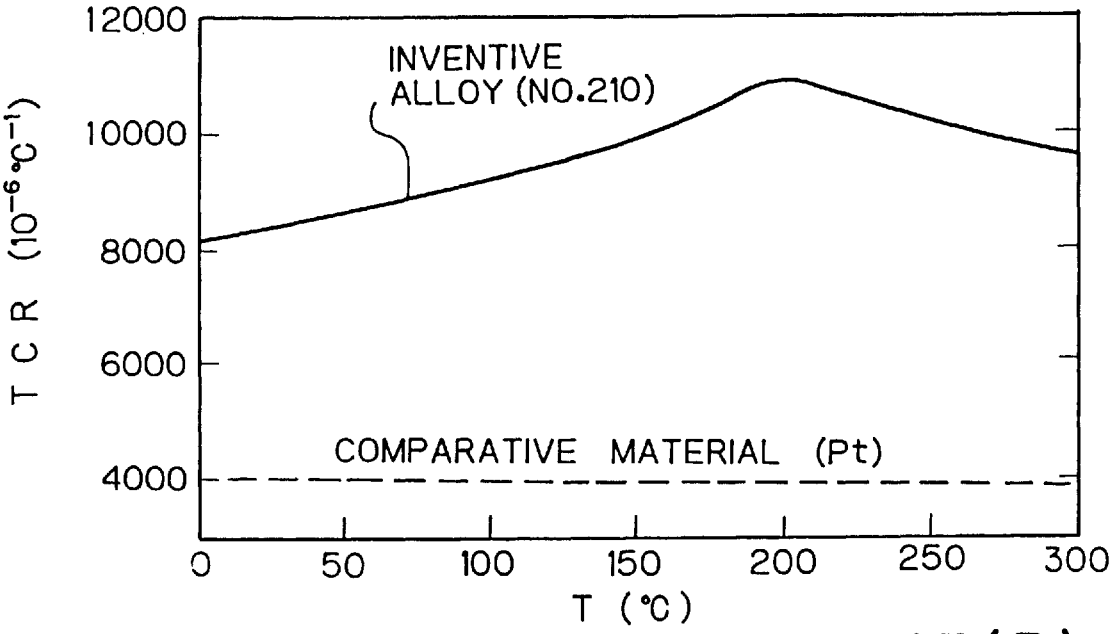
FIG. 15 includes graphs showing the TCR—T (temperature) characteristic and resistivity ρ—T characteristic of an inventive alloy (Alloy No. 210) is used and a comparative CO gas sensor, in which Pt is used.
Figure 15B:
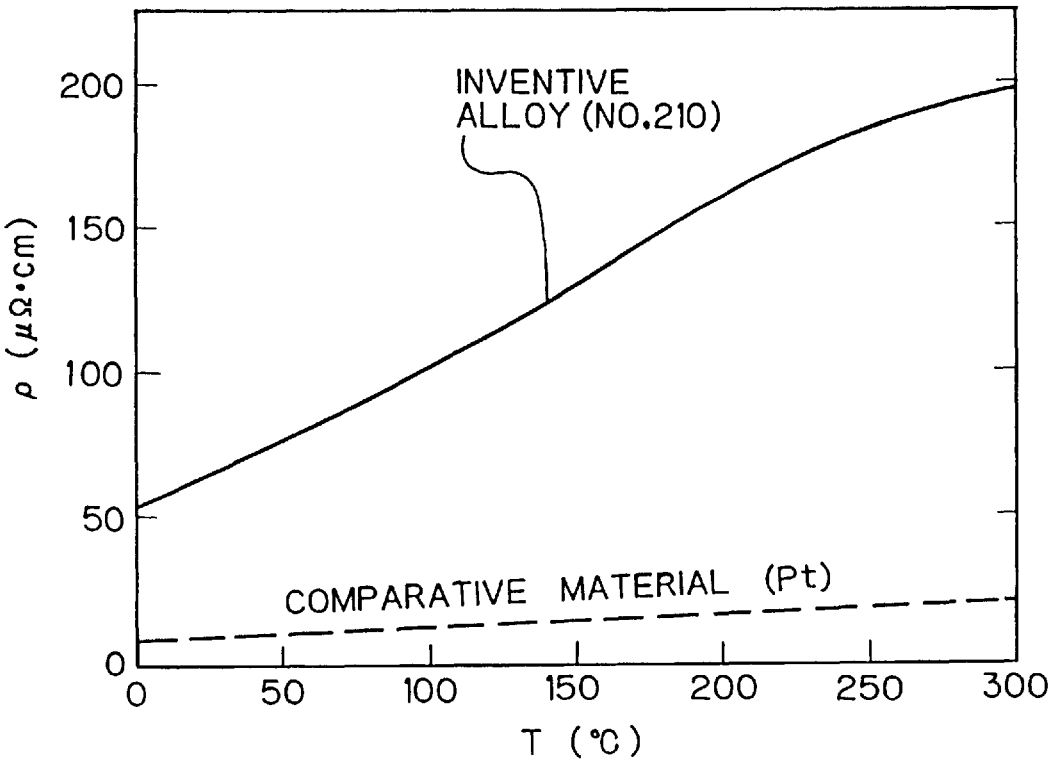
Figure 16:
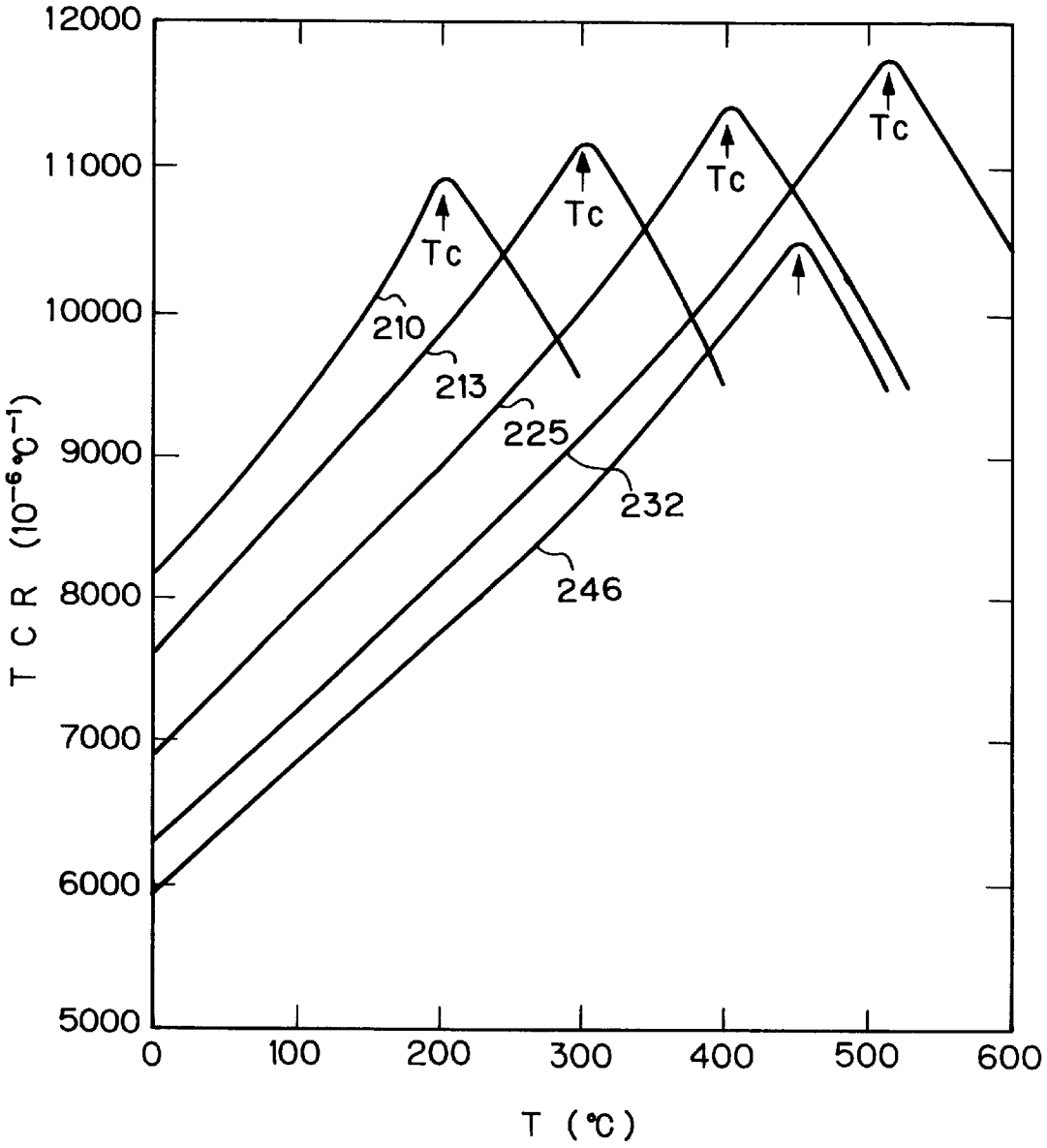
FIG. 16 illustrates the $H_2$ gas sensitivity characteristic of an $H_2$ gas sensor, in which an inventive alloy (Alloy No. 210, 213, 225, 232 and 246) is used, and a comparative CO gas sensor, in which Pt is used at sensor temperatures $T_s$.

FIGS. 15 and 16 are drawings similar to FIGS. 14 and 15, respectively. The samples also exhibit a peak in the TCR-T curve at the magnetic transforming point ($T_c$).

EXAMPLE 5

The 0.5 mm diameter wires (Alloy No. 107 and No. 210) produced in Examples 1 and 3 were further drawn into thin wires having a diameter of 0.03 mm. These wires were finally heat-treated in continuous heat-treating apparatus under a condition of 1000° C. of temperature, hydrogen atmosphere, and 2 m/min of conveying speed. This conveying speed is such that any defect on the wires can be detected by the naked eye. The temperature and gas condition are such that the metallic luster can be maintained and the material is fully softened. The wires were straightened out of the heat-treating apparatus, while being drawn.

Figure 1A:
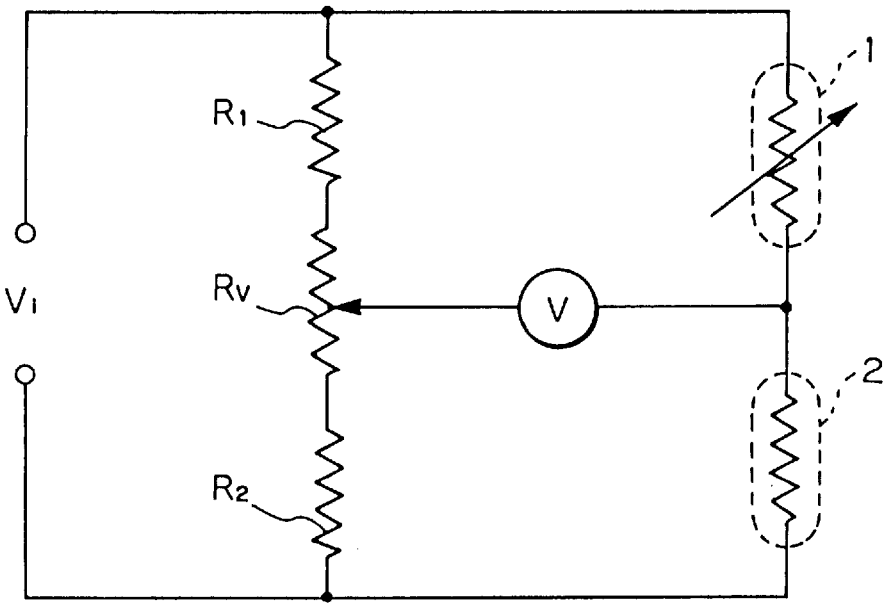
PRIOR ART Fig. 1(A)
FIGS. 1(A) and (B) show a bridge circuit used in various sensor devices, in which gas or temperature is detected based on the resistance change depending on the temperature.
Figure 1B:
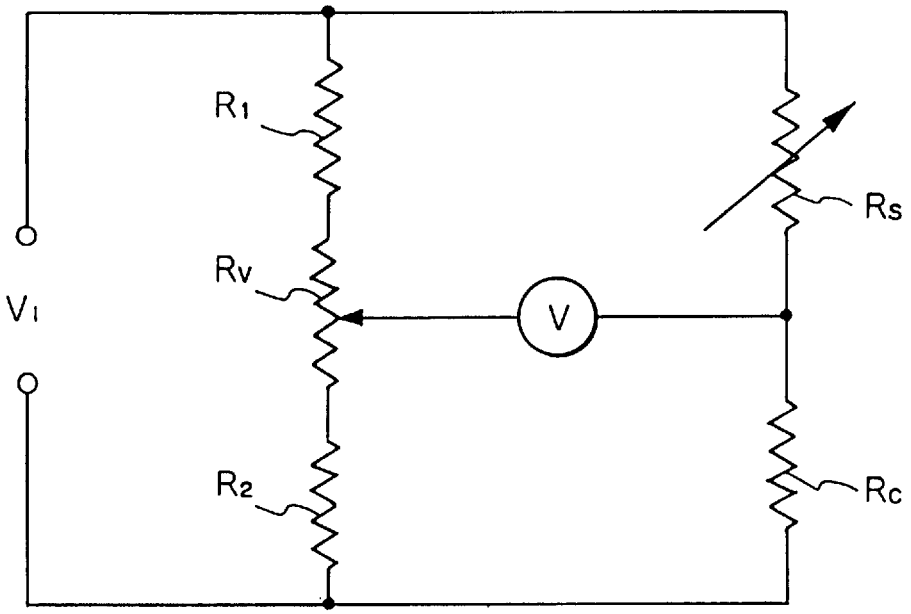
Figure 2:
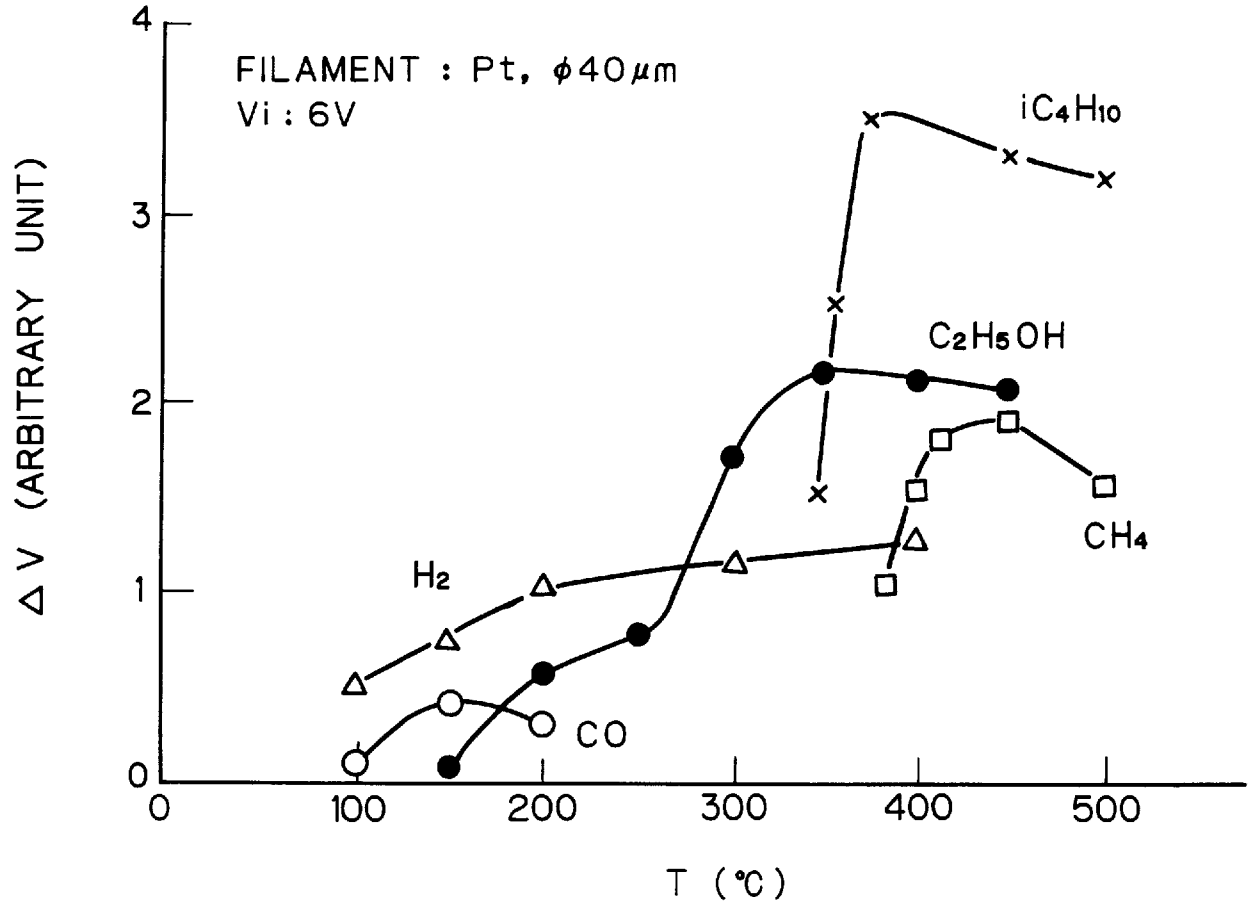
FIG. 2 is a graph showing the output voltage ΔV versus the operating temperature of a sensor and illustrates how a Pt filament used in a gas sensor is sensitive to various gases.

A thin wire was coiled to provide a coil having a diameter of approximately 1 mm, 25 coiling turns and approximately 10 mm in length. This coil was then connected to electrodes which are 20 mm apart. A pair of the coils, whose TCR and resistance are coincident to one another, was connected to the electrodes and then assembled in a bridge circuit as shown in FIG. 1.

A catalyst, which is active to gas, i.e., Pt black, PdO, $Al_2O_3$, $Cu_2O$, ZnO, $MnO_2$, $Sm_2O_3$ and $Rh_2O_3$, in the form of slurry was applied on one of the coils. Insulating material, which is inactive to gas, i.e., $Ni_2O_3$, $Al_2O_3$, CuO, $Cr_2O_3$ and $TiO_2$, in the form of slurry was applied on the other coil. The slurries were then dried. The former and latter coils were connected in the circuit shown in FIG. 1(A) as the components 1 and 2, respectively.

Figure 17A:
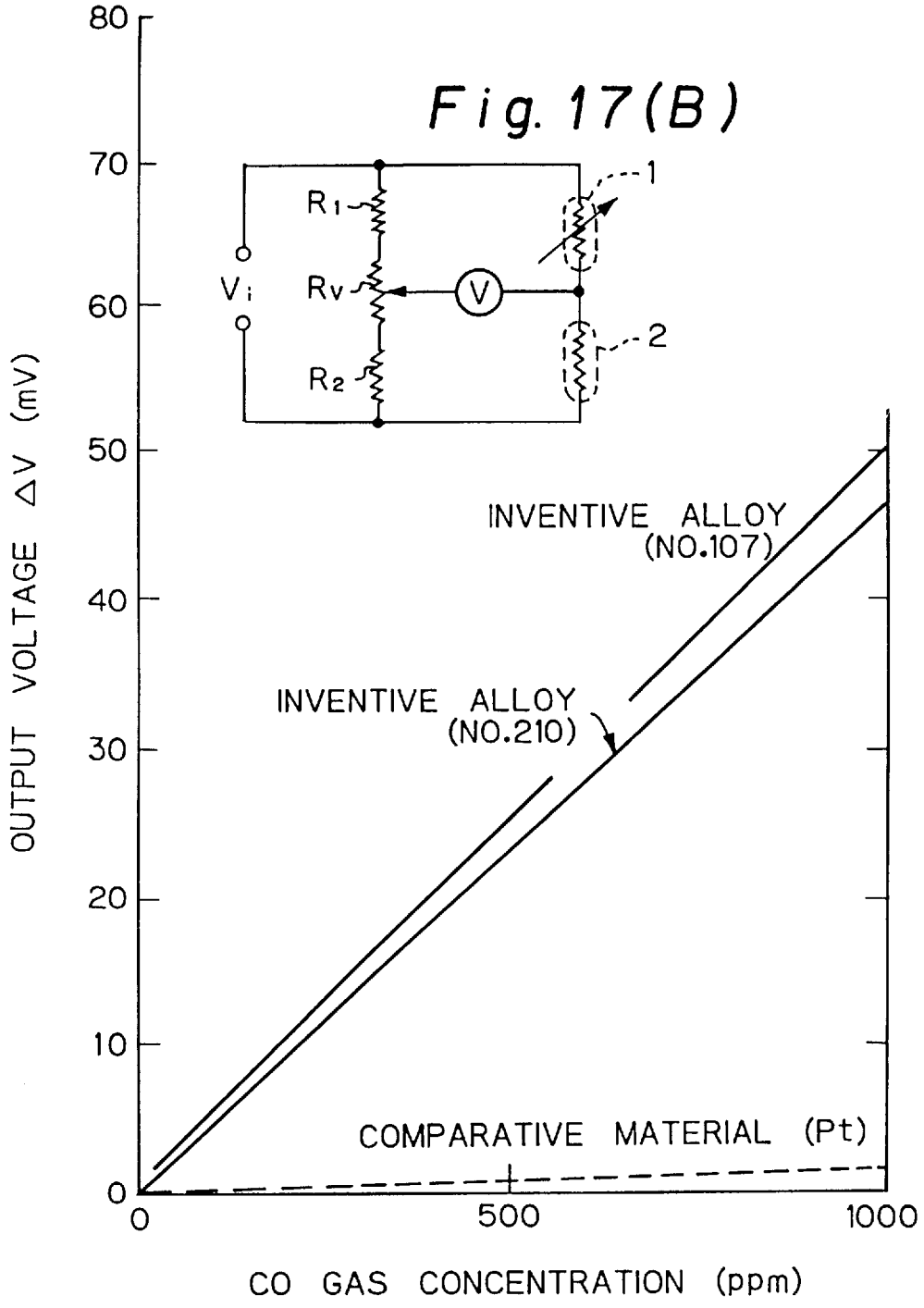
FIG. 17 is a graph showing the output voltage of a CO gas sensor, in which an inventive alloy (Alloy No. 107 or 210) is utilized, with respect to the detected CO gas concentration.
Figure 18:
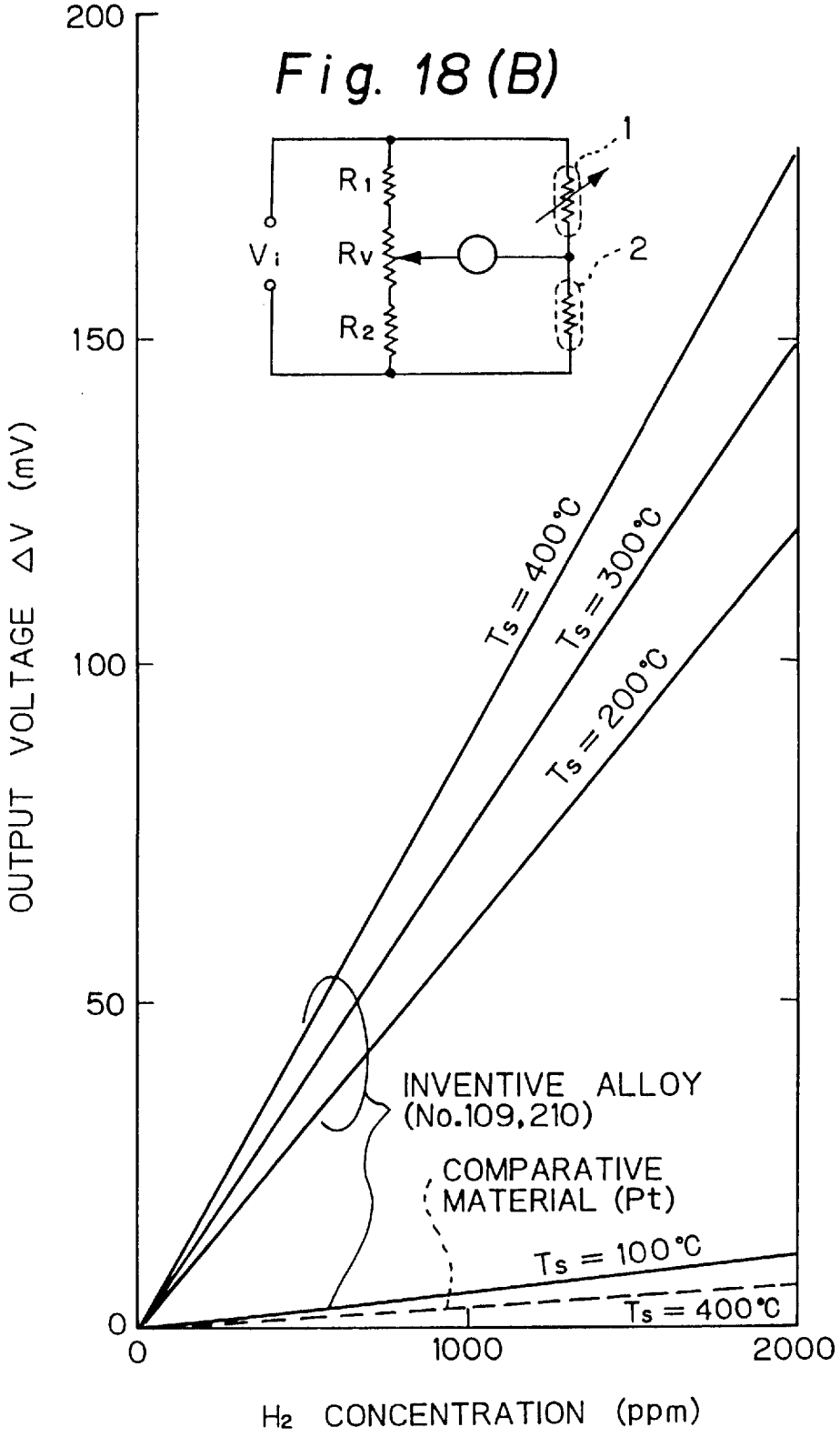
FIG. 18 is a graph showing the output voltage (ΔV) of an $H_2$ gas sensor, in which an inventive alloy (No. 109 or 210) or pure Pt is used.

Referring to FIG. 17 the gas-sensitivity of a gas sensor produced as above is shown. The bridge voltage Vi was 6V, the current through the components 1 and 2 was 40 mA, and the resistance of each component 1 or 2 was 100Ω. The gas sensitivity is 50 mV at 1000 ppm of CO concentration. This is approximately 27 times as high as a conventional sensor in which pure Pt is used as the coil material.

The inventive gas sensor is sensitively responsive to CO gas but is not at all reactive to the other gases, such as city gas, propane or ethylalcohol. The selectivity of the gas is therefore excellent.

EXAMPLE 6

The 0.5 mm diameter wire (Alloy No. 109) produced in Example 1 was further drawn into a thin wire having a diameter of 0.03 mm and was then continuously heat treated by the method described in Example 2. Polyimide coating (5 μm thick) was applied on one coil, gold was vapor-deposited on another coil (1 μm thickness) and $SiO_2$ coating (3 μm thick) was applied on another coil. A pair of coils, whose coating is one of the above three, and another pair of coils without coating were prepared as described in Example 2. $H_2$ gas sensors were then manufactured as is described in Example 5.

Resistivity of the $H_2$ gas sensors is shown in FIG. 16. The test conditions of the gas sensors were: bridge voltage $V_i$=2V; current through the components=40 mA; resistance= 200Ω, =100Ω, =60Ω, and 35Ω (no coating); and the temperature of components ($T_s$)=100° C., 200° C., 300° C. and 400° C.

The gas resistivity in terms of the output voltage (ΔV) was: 12 mV at 100° C.; 135 mV at 200° C.; 164 mV at 300° C.; and, 185 mV at 400° C. The resistivity at 400° C. is approximately 26 times as high as that of a conventional sensor, in which Pt is used as the coil material.

EXAMPLE 7

The same coating, manufacturing and test as in Example 6 were carried out with regard to the electrical resistant alloy No. 232. Similar sensitivity as shown in FIG. 16 was attained. The gas resistivity in terms of the output voltage (ΔV) was: 11 mV at 100° C.; 120 mV at 200° C.; 148 mV at 300° C.; and, 170 mV at 400° C. The resistivity at 400° C. is approximately 24 times as high as that of a conventional sensor, in which Pt is used as the coil material.

EXAMPLE 8

The gas sensor manufactured in Example 6 (Alloy No. 109) was used to detect ethanol, methane, isobutane, and butane. The sensitivity at 1000 ppm of gas concentration is shown in Table 5.

TABLE 5

| Kind of | Output Voltage (ΔV)-mV at 1000 ppm of Gas Concentration | | | | |
|---|---|---|---|---|---|
| of Gas | 100° C. | 200° C. | 300° C. | 400° C. | 500° C. |
| Ethanol ($C_2H_5OH$) | 10 | 80 | 98 | 122 | 147 |
| Methane ($CH_4$) | — | — | — | 96 | 118 |
| Isobutane ($iC_4H_{10}$) | — | — | — | 158 | 183 |
| Butane ($C_4H_{10}$) | — | — | — | 135 | 172 |

The sensitivity of the sensor to the above gases is greatly higher than that of a conventional sensor with the use of a pure Pt.

EXAMPLE 9

The gas sensor manufactured in Example 7 (Alloy No. 232) was used to detect ethanol, methane, isobutane, and butane. The sensitivity at 1000 ppm of gas concentration is shown in Table 6.

TABLE 6

| Kind of | Output Voltage (ΔV)-mV at 1000 ppm of Gas Concentration | | | | |
|---|---|---|---|---|---|
| of Gas | 100° C. | 200° C. | 300° C. | 400° C. | 500° C. |
| Ethanol ($C_2H_5OH$) | 6 | 64 | 77 | 92 | 108 |
| Methane ($CH_4$) | — | — | — | 85 | 97 |
| Isobutane ($iC_4H_{10}$) | — | — | — | 136 | 158 |
| Butane ($C_4H_{10}$) | — | — | — | 127 | 146 |

The sensitivity of the sensor to the above gases is greatly higher than that of a conventional sensor with the use of a pure Pt.

EXAMPLE 10

Figures 19A, 19B:
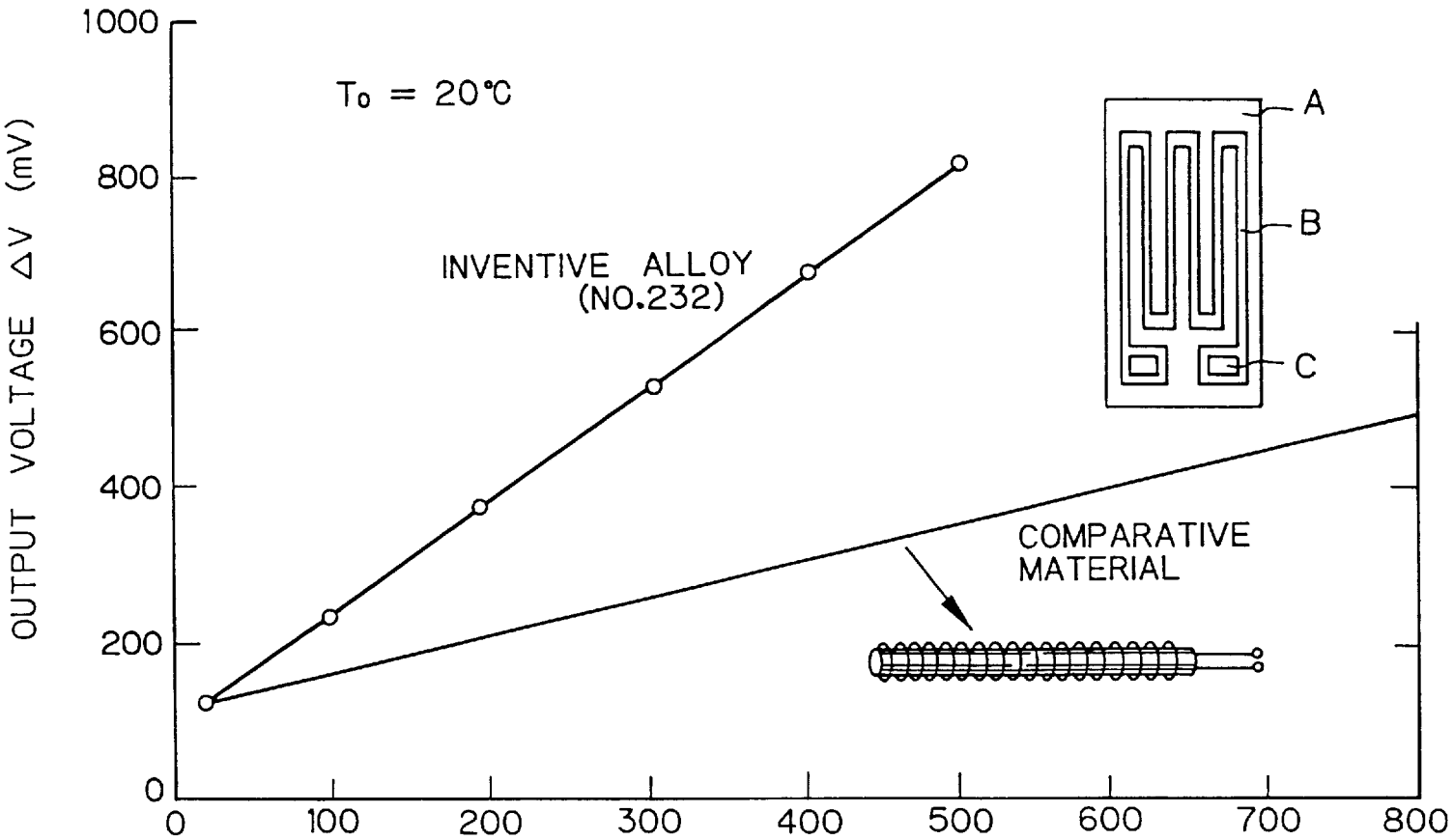
FIG. 19 is a graph showing the output voltage (ΔV) of a temperature sensor in which an inventive alloy (No. 232) or pure Pt is used.

Alloy No. 232 was melted, formed and heat-treated as in Example 1 except that, instead of drawing, rolling was carried out to produce a 10 μm thick and 50 mm wide foil. The foil was then delineated by means of a laser beam to form a pattern shown in FIG. 19 as "B". The delineated foil was then bonded on the insulating substrate A. The delineated foil B on the insulating substrate A was heat-treated as in Example 2. Electrodes C were formed by an electroless plating. On the entire parts A, B and C an $SiO_2$ coating was deposited by sputtering to 5 nm of thickness. The so treated members A, B and C form an active resistor and a standard resistor of a temperature sensor as shown in FIG. 19 in the present example. The resistors were mounted in a tube shown in FIG. 19. The temperature sensor had 100–1000Ω of resistance.

The output from the temperature sensor is shown in FIG. 19. For comparison purposes, the output of a conventional temperature sensor with the use of pure Pt is shown in FIG. 19. It is clear that the output from the inventive sensor is approximately twice as high as that of the conventional sensor.

Another inventive temperature sensor with the use of Alloy No. 109 attained virtually the same results as those of the above inventive sensor.

EXAMPLE 11

The Pd—Fe—Me alloys having the compositions as shown in Table 7 were subjected to the same production process as in Example 1, except that the cold-forming was 90%, and, further the heat treatment was 1000° C. for 15 minutes in air followed by air cooling. The resistivity and TCR of the alloys are shown in Table 7.

TABLE 7

| Alloy No. | Composition (at %) Fe | Auxiliary components | Resistivity ($\mu\Omega \cdot$ cm).°C. | TCR $10^{-6\circ}$ C.$^{-1}$, 0–200° C. |
|---|---|---|---|---|
| 7 | 35 | Ni 8 | 50 | 10200 |
| 12 | 20 | Co 10 | 55 | 9750 |
| 18 | 25 | Ag 6 | 56 | 8700 |
| 25 | 30 | Au 8 | 57 | 8400 |
| 31 | 42 | Pt 8 | 55 | 8900 |
| 37 | 33 | Rh 7 | 53 | 9100 |
| 44 | 50 | Ir 7 | 50 | 8200 |
| 49 | 15 | Os 12 | 57 | 8850 |
| 54 | 27 | Ru 7 | 50 | 8200 |
| 57 | 38 | Cr 4 | 50 | 8200 |
| 63 | 40 | V 3 | 53 | 8100 |
| 68 | 25 | Ti 2 | 54 | 7900 |
| 74 | 30 | Zr 3 | 56 | 8450 |
| 79 | 38 | Hf 2 | 49 | 8000 |
| 83 | 22 | Mo 4 | 54 | 8300 |
| 86 | 40 | Nb 2 | 50 | 8250 |
| 90 | 35 | W 4 | 52 | 9150 |
| 94 | 27 | Ta 4 | 51 | 8950 |
| 98 | 34 | Ni 5, Rh 3 | 55 | 10600 |
| 103 | 40 | Cu 3, Be I | 56 | 8100 |
| 107 | 30 | W 5, Pt 3 | 58 | 9800 |
| 115 | 22 | Al 1, In 1 | 56 | 8800 |
| 120 | 35 | Ru 6, Au 2 | 63 | 9900 |
| 124 | 24 | Ta 5, Ga 1 | 58 | 9500 |
| 129 | 36 | Si 1, Mo 2 | 57 | 9200 |
| 132 | 40 | V 2, Sb 1 | 55 | 8750 |
| 138 | 35 | Y 3, Hf 2, Sn 1 | 66 | 9500 |
| 144 | 8 | Nb 2, La 1, C 0.3 | 48 | 8900 |
| 150 | 60 | W 3, B 0.3, Rh 2 | 56 | 10100 |
| 155 | 33 | Zr 2, Ru 5, Ce 1 | 59 | 9800 |
| Comparative material | | Pt (Pure platinum) | 10.6 | 3867 |

Remarks: Balance of Fe and auxiliary compounds is Pd.

EXAMPLE 12

The Pd—Fe—Mn—Me alloys having the compositions as shown in Table 8 were subjected to the same production process as in Example 1, except that the cold-forming was 90%, and, further the heat treatment was 1000° C. for 15 minutes in air followed by air cooling. The resistivity and TCR of the alloys are shown in Table 8.

TABLE 8

| Alloy No. | Composition (at %) Fe | Mn | Auxiliary Components | Resistivity ($\mu\Omega \cdot$ cm).°C. | TCR $10^{-6\circ}$ C$^{-1}$, 0–200° C. |
|---|---|---|---|---|---|
| 5 | 25 | 5 | Ni 5 | 46 | 10700 |
| 8 | 35 | 10 | Ni 15 | 54 | 9420 |
| 15 | 55 | 5 | Co 5 | 52 | 7650 |
| 20 | 30 | 10 | Co 10 | 55 | 8900 |
| 25 | 20 | 10 | Az 3 | 45 | 9100 |
| 28 | 40 | 5 | Ag 12 | 48 | 8260 |
| 35 | 25 | 7 | Au 4 | 48 | 8810 |
| 40 | 35 | 3 | Au 13 | 46 | 8370 |
| 45 | 15 | 5 | Pt 5 | 49 | 8860 |
| 50 | 30 | 10 | Pt 10 | 47 | 9530 |

TABLE 8-continued

| Alloy No. | Composition (at %) Fe | Mn | Auxiliary Components | Resistivity ($\mu\Omega \cdot$ cm).°C. | TCR $10^{-6\circ}$ C$^{-1}$, 0–200° C. |
|---|---|---|---|---|---|
| 55 | 20 | 8 | Rh 2 | 50 | 9210 |
| 60 | 15 | 10 | Ir 3 | 52 | 8680 |
| 65 | 25 | 3 | Os 1 | 48 | 9050 |
| 70 | 30 | 7 | Ru 3 | 51 | 9240 |
| 75 | 10 | 15 | Cr 5 | 55 | 8580 |
| 80 | 25 | 10 | V 2 | 50 | 8400 |
| 85 | 35 | 5 | Ti 2 | 47 | 8260 |
| 90 | 20 | 10 | Zr 3 | 49 | 8630 |
| 95 | 30 | 5 | Hr 3 | 47 | 8800 |
| 100 | 15 | 10 | Mo 2 | 52 | 9030 |
| 105 | 25 | 7 | Hb 2 | 50 | 8620 |
| 110 | 20 | 10 | H 5 | 54 | 9100 |
| 115 | 35 | 5 | Ta 4 | 48 | 9260 |
| 120 | 50 | 3 | Ga 1 | 47 | 7820 |
| 125 | 15 | 10 | Ge 1 | 52 | 7960 |
| 130 | 35 | 5 | In 1 | 45 | 8080 |
| 135 | 25 | 3 | Be 1 | 45 | 8260 |
| 140 | 20 | 10 | Sn 1 | 53 | 8350 |
| 145 | 35 | 5 | Sb 1 | 48 | 8190 |
| 150 | 25 | 3 | Cu 2 | 48 | 8630 |
| 155 | 30 | 5 | Al 1.5 | 47 | 9760 |
| 160 | 40 | 10 | Si 1.5 | 55 | 9020 |
| 165 | 15 | 10 | C 0.5 | 59 | 7630 |
| 170 | 30 | 5 | B 0.3 | 57 | 7870 |
| 175 | 25 | 8 | Y 2 | 49 | 9220 |
| 180 | 20 | 10 | La 2 | 53 | 8700 |
| 185 | 30 | 5 | Ce 2 | 48 | 8460 |
| 200 | 40 | 10 | Ni 5, Co 5 | 55 | 9150 |
| 210 | 25 | 5 | Ni 5, Pt 5 | 52 | 10900 |
| 220 | 40 | 5 | Au 5, Ag 5 | 49 | 9030 |
| 230 | 30 | 10 | Rh 2, Ti 1 | 57 | 9570 |
| 240 | 20 | 5 | Ir 2, Cr 1, Nb 1 | 48 | 9310 |
| 250 | 35 | 3 | Os 2, V 2, Ga 1 | 47 | 8830 |
| 260 | 25 | 8 | Ru 1, In 1, Sb 1 | 52 | 8960 |
| 270 | 20 | 10 | Zr 2, Al 1, Sn 1 | 55 | 9470 |
| 280 | 35 | 3 | Hf 2, Be 1, Si 1 | 53 | 9590 |
| 290 | 30 | 5 | Mo 2, Y 1, Cu 1 | 53 | 9360 |
| 300 | 15 | 10 | Pt 5, Ge 1, C 0.5 | 56 | 9770 |
| 310 | 40 | 5 | Ag 5, La 2, B 0.5 | 52 | 9360 |
| 320 | 20 | 10 | Au 3, Ta 5, Al 1 | 55 | 8850 |
| 330 | 35 | 10 | Ru 2, Ti 1, W 2, Si 1 | 57 | 8930 |
| 340 | 25 | 5 | Pt 3, Rh 2, Zr 1, Cu 2 | 50 | 9160 |
| Comparative Material | | | Pt (Pure platinum) | 10.6 | 3867 |

We claim:

1. An electrical resistant alloy consisting, by atomic %, of from 5 to 65% of Fe, and from 0.01 to 20% in total of at least one auxiliary component selected from the group consisting of 20% or less of Ni, 20% or less of Co, 20% or less of Ag, 3 to 9% of Au, 20% or less of Pt, 10% or less of Rh, 10% or less of Ir, 10% or less of Os, 10% or less of Ru, 10% or less of Cr, 5% or less of V, 5% or less of Ti, 5% or less of Zr, 5% or less of Hf, 8% or less of Mo, 5% or less of Nb, 10% or less of W, 8% or less of Ta, 3% or less of Ga, 3% or less of Ge, 3% or less of In, 3% or less of Be, 5% or less of Sn, 3% or less of Sb, 5% or less of Cu, 5% or less of Al, 5% or less of Si, 2% or less of C, 2% or less of B, and 5% or less of a rare earth element, the balance being essentially Pd and a minor amount of impurities, said alloy being an annealed alloy and having $4000\times10^{-6\circ}$ C.$^{-1}$ or more of temperature coefficient of resistance in a temperature range of from 0° to 200° C.

2. An electrical resistant alloy according to claim 1, wherein Co is selected as a first auxiliary component and at least one element other than Co is selected as a second auxiliary element.

3. An electrical resistant alloy according to claim 1, wherein said at least one element is selected from the group consisting of Ni, Ag, Au, Pt, Rh, Ir, Os, Ru, Cr, V, Ti, Zr, Hf, Mo, Nb, W, Ta, Ga, Ge, In, Be, Sn, Sb, Cu, Al, Si, C, B, and a rare earth element.

4. An electrical resistant alloy consisting, by atomic %, of from 5 to 65% of Fe, from 5 to 65% of Mn, and from 0.01 to 20% in total of at least one auxiliary component selected from the group consisting of 20% or less of Ni, 20% or less of Co, 20% or less of Ag, 3 to 9% of Au, 20% or less of Pt, 10% or less of Rh, 10% or less of Ir, 10% or less of Os, 10% or less of Ru, 10% or less of Cr, 5% or less of V, 5% or less of Ti, 5% or less of Zr, 5% or less of Hf, 8% or less of Mo, 5% or less of Nb, 10% or less of W, 8% or less of Ta, 3% or less of Ga, 3% or less of Ge, 3% or less of In, 3% or less of Be, 5% or less of Sn, 3% or less of Sb, 5% or less of Cu, 5% or less of Al, 5% or less of Si, 2% or less of C, 2% or less of B, and 5% or less of a rare earth element, the balance being essentially Pd and a minor amount of impurities, said alloy being an annealed alloy and having $4000\times10^{-6}$° C.$^{-1}$ or more of temperature coefficient of resistance in a temperature range of from 0° to 200° C.

5. An electrical resistant alloy according to claim 4, wherein Co is selected as a first auxiliary component and at least one element other than Co is selected as a second auxiliary element.

6. An electrical resistant alloy according to claim 4, wherein said at least one element is selected from the group consisting of Ni, Ag, Au, Pt, Rh, Ir, Os, Ru, Cr, V, Ti, Zr, Hf, Mo, Nb, W, Ta, Ga, Ge, In, Be, Sn, Sb, Cu, Al, Si, C, B, and a rare earth element.

7. An electrical resistant alloy according to claim 1, 2, 3, 4 or 5, wherein said alloy is in the form of a foil, thin wire or a ribbon.

8. An electrical resistant alloy according to claim 7, wherein said alloy is annealed in a temperature range of from 600° to 1300° C.

* * * * *